US008016392B2

(12) United States Patent
Sekiguchi

(10) Patent No.: US 8,016,392 B2
(45) Date of Patent: Sep. 13, 2011

(54) LIQUID TRANSPORT APPARATUS, LIQUID TRANSPORT HEAD, AND PIEZOELECTRIC ACTUATOR

(75) Inventor: Yasuhiro Sekiguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 234 days.

(21) Appl. No.: 12/284,992

(22) Filed: Sep. 26, 2008

(65) Prior Publication Data

US 2009/0085435 A1 Apr. 2, 2009

(30) Foreign Application Priority Data

Sep. 28, 2007 (JP) ..... 2007-253270

(51) Int. Cl.
*B41J 2/45* (2006.01)

(52) U.S. Cl. ..... 347/68

(58) Field of Classification Search ..... 347/68–72
See application file for complete search history.

(56) References Cited

U.S. PATENT DOCUMENTS

| | | | |
|---|---|---|---|
| 2002/0140783 | A1 | 10/2002 | Takahashi |
| 2003/0107622 | A1 | 6/2003 | Sugahara |
| 2003/0142173 | A1 | 7/2003 | Takahashi |
| 2007/0076054 | A1 | 4/2007 | Sugahara et al. |

FOREIGN PATENT DOCUMENTS

| | | |
|---|---|---|
| EP | 08017051.7 | 2/2009 |
| JP | 2007-118585 | 5/2007 |

*Primary Examiner* — Lamson D Nguyen

(74) *Attorney, Agent, or Firm* — Frommer Lawrence & Haug LLP

(57) ABSTRACT

A liquid transport apparatus includes: a channel unit; a piezoelectric actuator which applies a pressure to a liquid in a pressure chamber and which has a first and a second piezoelectric layers, a first, a second, and a third electrodes, the first piezoelectric layer covering the pressure chamber and polarized in a thickness direction, the second piezoelectric layer being joined to a surface of the first piezoelectric layer and polarized in a thickness direction, the first electrode being formed on a surface of the first piezoelectric layer, the second electrode being formed on a surface of the second piezoelectric layer, the third electrode being formed between the first piezoelectric layer and the second piezoelectric layer; a driving mechanism which drives the piezoelectric actuator and which has a potential applying mechanism applying potentials to the first, second, and third electrode respectively, and a controller controlling the potential applying mechanism.

10 Claims, 18 Drawing Sheets

LIQUID TRANSPORT APPARATUS, LIQUID TRANSPORT HEAD, AND PIEZOELECTRIC ACTUATOR

CROSS REFERENCE TO RELATED APPLICATION

The present application claims priority from Japanese Patent Application No. 2007-253270, filed on Sep. 28, 2007, the disclosure of which is incorporated herein by reference in its entirety.

BACKGROUND OF THE INVENTION

1. Field of the Invention

The present invention relates to a liquid transport apparatus which transports a liquid, a liquid transport head which transports a liquid, and a piezoelectric actuator which deforms when a potential is applied thereto.

2. Description of the Related Art

In an inkjet printer (liquid transport apparatus) described in US Patent Application Publication No. US2007/0076054 (corresponding to Japanese Patent Application Laid-open No. 2007-118585), a vibration plate serving also as a common electrode is arranged to cover pressure chambers, a piezoelectric layer is joined to an upper surface of the vibration plate, and on an upper surface of the piezoelectric layer, individual electrodes are formed at portions facing the pressure chambers. When a driving potential is applied to the individual electrode, a potential difference occurs between the individual electrode and the vibration plate as the common electrode kept at ground potential, and due to this potential difference, an electric field in a thickness direction is generated in a portion, of the piezoelectric layer, sandwiched between these electrodes. Due to the electric field, this portion of the piezoelectric layer contracts in a horizontal direction, and as a result, portions, of the piezoelectric layer and the vibration plate, facing the pressure chamber deform as a whole so as to project toward the pressure chamber side to reduce the volume of the pressure chamber. This increases the pressure of ink in the pressure chamber, resulting in the jetting of the ink from a nozzle communicating with the pressure chamber.

However, in the inkjet printer described in US Patent Application Publication No. 2007/0076054, since the piezoelectric layer and the vibration plate deform so as to project only toward the pressure chamber side from the horizontal state, a change amount of the volume of the pressure chamber caused by the deformation of the piezoelectric layer and the vibration plate is small and thus a high pressure cannot be applied to the ink in the pressure chamber.

SUMMARY OF THE INVENTION

It is an object of the present invention to provide a liquid transport apparatus and a liquid transport head capable of applying a high pressure to a liquid in a pressure chamber, and a piezoelectric actuator capable of great deformation.

According to a first aspect of the present invention, there is provided a liquid transport apparatus which transports a liquid, including: a channel unit which has a liquid transport channel through which the liquid is transported and a pressure chamber formed in the liquid transport channel; a piezoelectric actuator which applies a pressure to the liquid in the pressure chamber and which has a first piezoelectric layer, a second piezoelectric layer, a first electrode, a second electrode, and a third electrode, the first piezoelectric layer covering the pressure chamber and polarized in a thickness direction of the first piezoelectric layer, the second piezoelectric layer being joined to a surface, of the first piezoelectric layer, on a side not facing the pressure chamber and polarized in a thickness direction of the second piezoelectric layer, the first electrode being formed on a surface of the first piezoelectric layer, on a side facing the pressure chamber, at a portion facing the pressure chamber, the second electrode being formed on a surface of the second piezoelectric layer, on a side not facing the first piezoelectric layer, at a portion facing the pressure chamber, the third electrode being formed between the first piezoelectric layer and the second piezoelectric layer at a position at which the third electrode faces the pressure chamber; a driving mechanism which drives the piezoelectric actuator and which has a potential applying mechanism applying potentials to the first electrode, the second electrode, and the third electrode respectively, and a controller controlling the potential applying mechanism, wherein the controller controls the potential applying mechanism to switch between a first state and a second state, the first state being a state in which the first electrode and the third electrode have a potential difference and the second electrode and the third electrode are at a same potential, and the second state being a state in which the second electrode and the third electrode have a potential difference and the first electrode and the third electrode are at a same potential.

According to the first aspect of the present invention, in the first state, since the first electrode and the third electrode have a potential difference and the second electrode and the third electrode are at the same potential, an electric field is generated in the portion, of the first piezoelectric layer, facing the pressure chamber. The portion, of the first piezoelectric layer, facing the pressure chamber becomes an active layer which expands or contracts, and the second piezoelectric layer becomes an inactive layer which does not expand nor contract but is deformed due to the expansion or the contraction of the first piezoelectric layer. Consequently, the portions, of the first piezoelectric layer and the second piezoelectric layer, facing the pressure chamber deform as a whole so as to project toward the pressure chamber side or toward the opposite side of the pressure chamber.

On the other hand, in the second state, since the second electrode and the third electrode have a potential difference and the first electrode and the third electrode are at the same potential, an electric field is generated in the portion, of the second piezoelectric layer, facing the pressure chamber. The portion, of the second piezoelectric layer, facing the pressure chamber becomes an active layer which expands or contracts, and the first piezoelectric layer becomes an inactive layer which does not expand nor contract but is deformed due to the expansion or the contraction of the second piezoelectric layer. Consequently, the portions, of the first piezoelectric layer and the second piezoelectric layer, facing the pressure chamber are deformed as a whole so as to project toward the opposite side to that in the first state.

By making the portions, of the first piezoelectric layer and the second piezoelectric layer, facing the pressure chamber to be deformed so as to project toward the pressure chamber side and toward the opposite side of the pressure chamber by switching between the first state and the second state, it is possible to greatly change the volume of the pressure chamber. Consequently, a high pressure can be applied to the liquid in the pressure chamber, and thus the liquid can be efficiently transported in the liquid transport channel.

It should be noted that, in the present invention, the state where the first piezoelectric layer covers the plural pressure chambers includes not only a state in which the first piezoelectric layer directly covers the plural pressure chambers but also a state in which another layer interposed between the plural pressure chambers and the first piezoelectric layer covers the pressure chambers and the first piezoelectric layer is disposed on a surface, of the interposed layer, not facing the pressure chambers to extend over the pressure chambers. Further, the same potential includes not only a state in which there is no potential difference between two electrodes but also a state in which a potential difference, if any between two electrodes, is minute.

In the liquid transport apparatus of the present invention, the controller may control the potential applying mechanism to selectively apply one of a predetermined first potential and a predetermined second potential different from the first potential to the third electrode in a state that the first electrode is kept at the first potential and the second electrode is kept at the second potential. When the first potential is applied to the third electrode while the first electrode is kept at the first potential and the second electrode is kept at the second potential, the second state is produced. On the other hand, when the second potential is applied to the third electrode while the first electrode is kept at the first potential and the second electrode is kept at the second potential, the first state is produced. Therefore, by selectively applying the first potential and the second potential to the third electrode while keeping the first electrode at the first potential and keeping the second electrode at the second potential, it is possible to easily switch between the first state and the second state. Further, when a plurality of pressure chambers is provided, and a plurality of first electrodes, a plurality of second electrodes, and a plurality of third electrodes are provided respectively, the first electrodes and the second electrodes may be kept at the first potential and the second potential respectively, and therefore, there is no need to provide independent wirings for the first electrodes and the second electrodes, which simplifies the wirings connected to the first electrodes and the second electrodes.

In the liquid transport apparatus of the present invention, the second potential may be a potential higher than the first potential, the first piezoelectric layer may be polarized in a direction from the third electrode toward the first electrode, and the second piezoelectric layer may be polarized in a direction from the second electrode toward the third electrode. In this case, when the first potential is applied to the third electrode, an electric field in the direction from the second electrode toward the third electrode is generated in the second piezoelectric layer, and the direction of the electric field matches the direction of the polarization direction in the second piezoelectric layer. When the second potential is applied to the third electrode, an electric field in the direction from the third electrode toward the first electrode is generated in the first piezoelectric layer, and the direction of the electric field matches the direction of the polarization in the first piezoelectric layer. Therefore, an electric field in the opposite direction of the polarization direction is not generated in the first piezoelectric layer nor in the second piezoelectric layer, and thus the polarizations in the thickness direction of the first piezoelectric layer and the second piezoelectric layer are not weakened.

In the liquid transport apparatus of the present invention, the first potential may be a potential higher than the second potential, the first piezoelectric layer may be polarized in a direction from the first electrode toward the third electrode, and the second piezoelectric layer may be polarized in a direction from the third electrode toward the second electrode. In this case, when the first potential is applied to the third electrode, an electric field in the direction from the third electrode toward the second electrode is generated in the second piezoelectric layer, and the direction of the electric field matches the direction of the polarization direction in the second piezoelectric layer. When the second potential is applied to the third electrode, an electric field in the direction from the first electrode toward the third electrode is generated in the first piezoelectric layer, and the direction of the electric field matches the direction of the polarization in the first piezoelectric layer. Therefore, an electric field in the opposite direction of the polarization direction is not generated in the first piezoelectric layer nor in the second piezoelectric layer, and thus the polarizations in the thickness direction of the first piezoelectric layer and the second piezoelectric layer are not weakened.

In the liquid transport apparatus of the present invention, the controller may control the potential applying mechanism to produce the first state, while keeping the second electrode and the third electrode at a predetermined first potential, by applying a second potential different from the first potential to the first electrode, and to produce the second state by applying the second potential to the second electrode, while keeping the first electrode and the third electrode at the first potential.

In the liquid transport apparatus of the present invention, the first piezoelectric layer may be polarized in a direction from the first electrode toward the third electrode, and the second piezoelectric layer may be polarized in a direction from the second electrode toward the third electrode.

The liquid transport apparatus of the present invention may further include a cover member which is disposed on the surface, of the first piezoelectric layer, on the side facing the pressure chamber and which covers the first electrode. If the first electrode is exposed to the pressure chamber, there is a risk that the first electrode may come into contact with the liquid in the pressure chamber to be corroded or to cause the occurrence of electrolysis of the liquid in the pressure chamber, but by covering the first electrode by the cover member, it is possible to prevent the liquid in the pressure chamber from coming into contact with the first electrode.

According to a second aspect of the present invention, there is provided a liquid transport apparatus which transports a liquid, including: a channel unit which has a liquid transport channel through which the liquid is transported and a pressure chamber formed in the liquid transport channel; a piezoelectric actuator which has a first piezoelectric layer covering the pressure chamber and polarized in a thickness direction of the first piezoelectric layer, and a second piezoelectric layer joined to a surface, of the first piezoelectric layer, on a side not facing the pressure chamber and polarized in a thickness direction of the second piezoelectric layer, and which applies a pressure to the liquid in the pressure chamber; and a driving mechanism driving the piezoelectric actuator, wherein the driving mechanism applies an electric field to a portion, of one of the first piezoelectric layer and the second piezoelectric layer, facing the pressure chamber in the thickness direction of one of the first and second piezoelectric layer.

According to the second aspect of the present invention, when the driving mechanism applies the electric field in the thickness direction to a portion, of the first piezoelectric layer, facing the pressure chamber and does not apply an electric field to the second piezoelectric layer, a portion, of the first piezoelectric layer, facing the pressure chamber becomes an active layer which expands or contracts in a direction perpendicular to the thickness direction, and the second piezoelectric layer becomes an inactive layer which does not expand nor contract but is deformed due to the expansion or the contraction of the first piezoelectric layer. That is, the second piezoelectric layer operates as a layer restricting the deformation of the first piezoelectric layer. Consequently, the portions, of the first piezoelectric layer and the second piezoelectric layer, facing the pressure chamber are deformed as a whole so as to project toward the pressure chamber side or toward the opposite side of the pressure chamber.

On the other hand, when the driving mechanism applies an electric field in the thickness direction to a portion, of the second piezoelectric layer, facing the pressure chamber and does not apply an electric field to the first piezoelectric layer, the portion, of the second piezoelectric layer, facing the pressure chamber becomes an active layer which expands or contacts in the direction perpendicular to the thickness direction, and the first piezoelectric layer becomes an inactive layer which does not expand nor contract but is deformed due to the expansion or the contraction of the second piezoelectric layer. That is, the first piezoelectric layer operates as a layer restricting the deformation of the second piezoelectric layer. Consequently, the portions, of the first piezoelectric layer and the second piezoelectric layer, facing the pressure chamber are deformed as a whole so as to project toward the opposite side to that when the electric field is applied to the first piezoelectric layer.

By making the portions, of the first piezoelectric layer and the second piezoelectric layer, facing the pressure chamber to be deformed so as to project both toward the pressure chamber side and toward the opposite side of the pressure chamber by switching between these two states, it is possible to greatly change the volume of the pressure chamber. Therefore, a high pressure can be applied to the liquid in the pressure chamber, and thus the liquid can be efficiently transported in the liquid transport channel.

According to a third aspect of the present invention, there is provided a liquid transport head which transports a liquid, including: a channel unit which has a liquid transport channel through which the liquid is transported and a pressure chamber formed in the liquid transport channel; and a piezoelectric actuator which applies a pressure to the liquid in the pressure chamber and which has a first piezoelectric layer, a second piezoelectric layer, a first electrode, a second electrode, and a third electrode, the first piezoelectric layer covering the pressure chamber and polarized in a thickness direction of the first piezoelectric layer, the second piezoelectric layer being joined to a surface, of the first piezoelectric layer, on a side not facing the pressure chamber and polarized in a thickness direction of the second piezoelectric layer, the first electrode being formed on a surface of the first piezoelectric layer, on a side facing the pressure chamber, at a portion facing the pressure chamber, the second electrode being formed on a surface of the second piezoelectric layer, on a side not facing the first piezoelectric layer, at a portion facing the pressure chamber, and the third electrode being formed between the first piezoelectric layer and the second piezoelectric layer at a position at which the third electrode faces the pressure chamber, wherein potentials are applied to the first electrode, the second electrode, and the third electrode respectively.

In the liquid transport head of the present invention, one of a predetermined first potential and a predetermined second potential different from the first potential may be selectively applied to the third electrode in a state that the first electrode is kept at the first potential and the second electrode is kept at the second potential.

According to a fourth aspect of the present invention, there is provided a piezoelectric actuator including: a first piezoelectric layer which is polarized in a thickness direction of the first piezoelectric layer; a second piezoelectric layer which is joined to one surface of the first piezoelectric layer and which is polarized in a thickness direction of the second piezoelectric layer; a first electrode formed on the other surface, of the first piezoelectric layer, on a side not facing the second piezoelectric layer; a second electrode formed on a surface of the second piezoelectric layer, on a side not facing the first piezoelectric layer, at a portion facing the first electrode; and a third electrode formed between the first piezoelectric layer and the second piezoelectric layer at a position at which the third electrode faces the first electrode and the second electrode, wherein potentials are applied individually to the first electrode, the second electrode, and the third electrode respectively.

In the piezoelectric actuator of the present invention, one of a predetermined first potential and a predetermined second potential different from the first potential may be selectively applied to the third electrode in a state that the first electrode is kept at the first potential and the second electrode is kept at the second potential.

DETAILED DESCRIPTION OF THE PREFERRED EMBODIMENTS

Hereinafter, a preferred embodiment of the present invention will be described.

Figure 1:
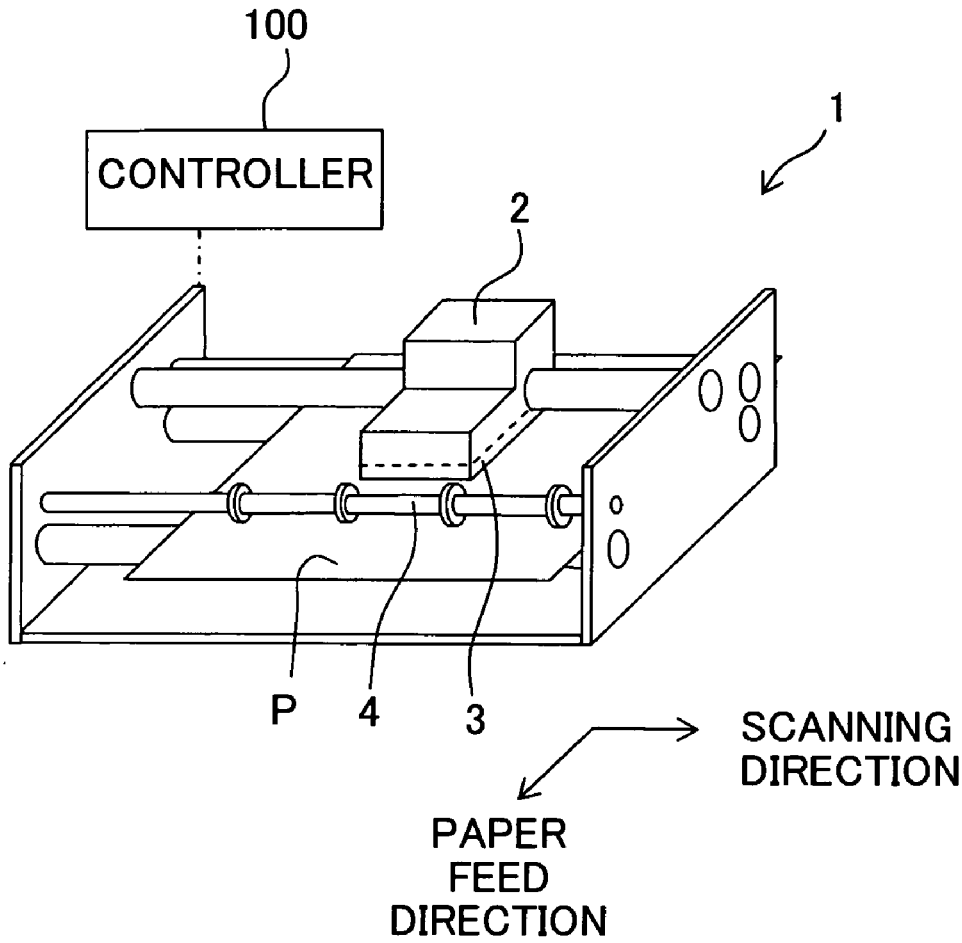
FIG. 1 is a view showing a schematic structure of a printer according to an embodiment of the present invention.

FIG. 1 is a view showing a schematic structure of a printer according to this embodiment. As shown in FIG. 1, the printer 1 (liquid transport apparatus) includes a carriage 2, an inkjet head 3 (liquid transport head), a paper feed roller 4, and so on. Further, the operation of the printer 1 is controlled by a control device 100. The carriage 2 reciprocates in the right and left direction in FIG. 1 (scanning direction). The inkjet head 3 is attached on a lower surface of the carriage 2 and jets ink from nozzles 15 (to be described later) (see FIG. 2). The paper feed roller 4 conveys recording paper P in a near side direction in FIG. 1 (paper feed direction). In the printer 1, printing on the recording paper P is performed in such a manner that the nozzles 15 (see FIG. 2) of the inkjet head 3 which reciprocates with the carriage 2 in the scanning direction jet the ink to the recording paper P conveyed in the paper feed direction by the paper feed roller 4.

Figure 2:
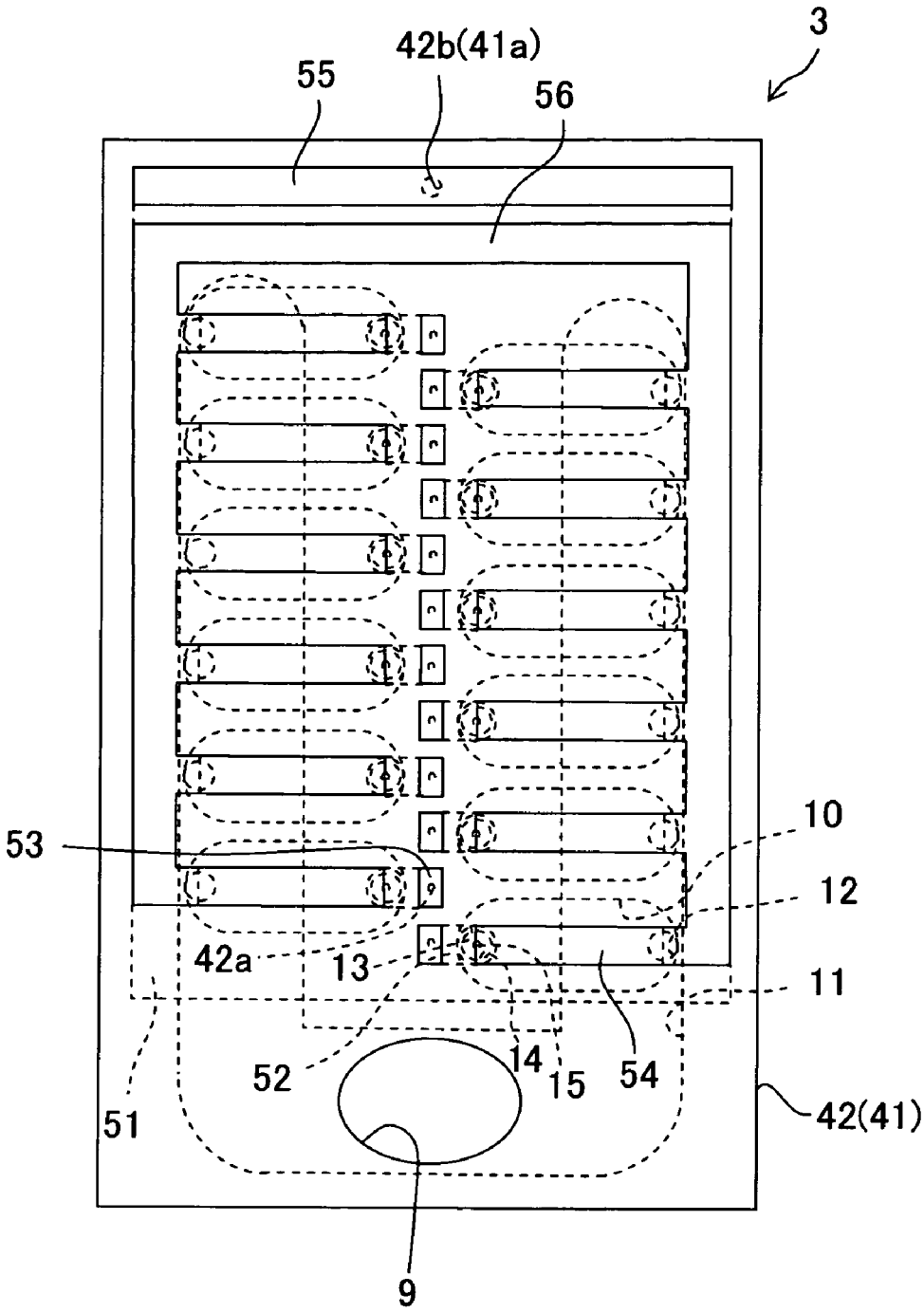
FIG. 2 is a plane view of an inkjet head in FIG. 1.
Figure 3:
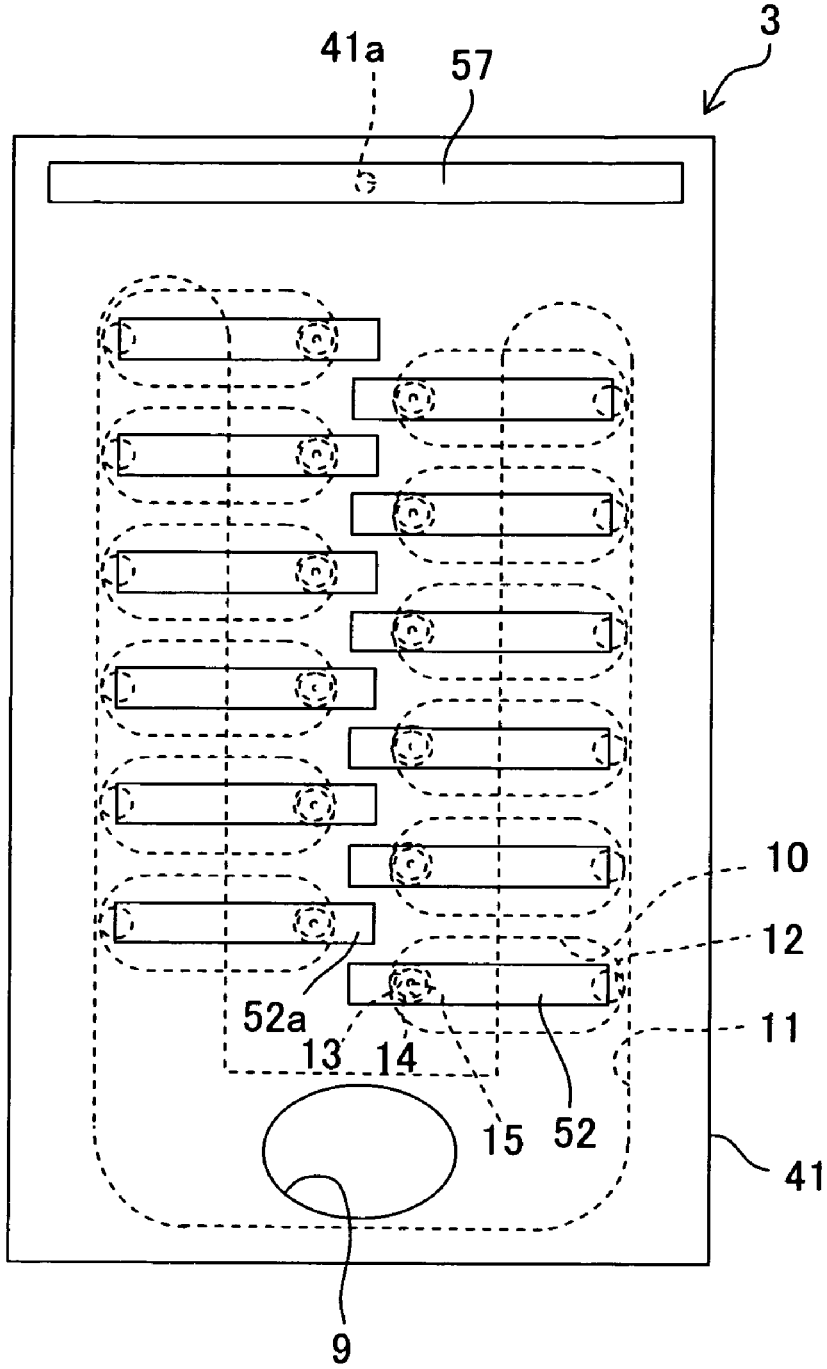
FIG. 3 is a view showing the inkjet head in FIG. 2 from which an upper piezoelectric layer is removed.
Figure 4:
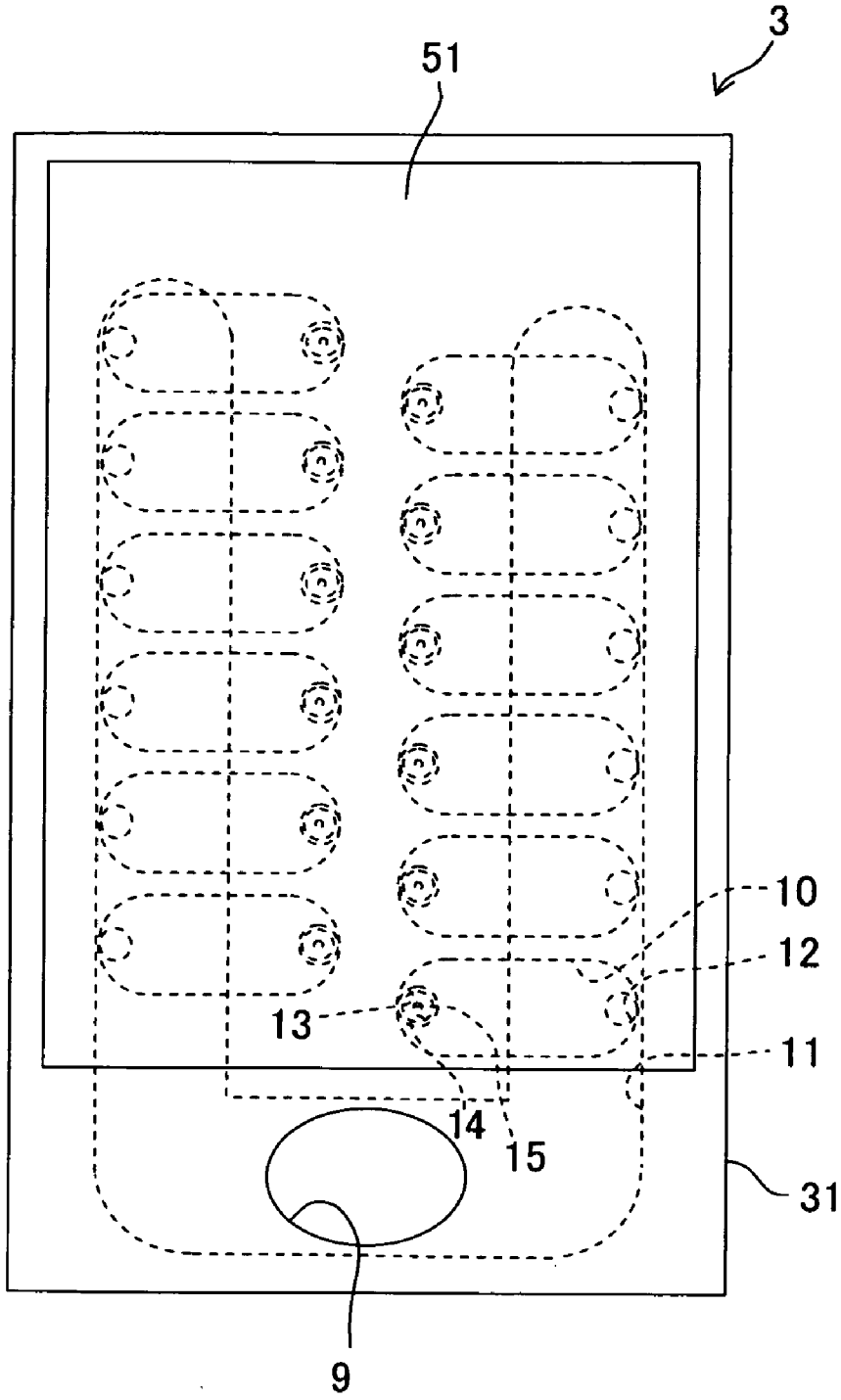
FIG. 4 is a view showing the inkjet head in FIG. 2 from which two piezoelectric layers are removed.
Figure 5:
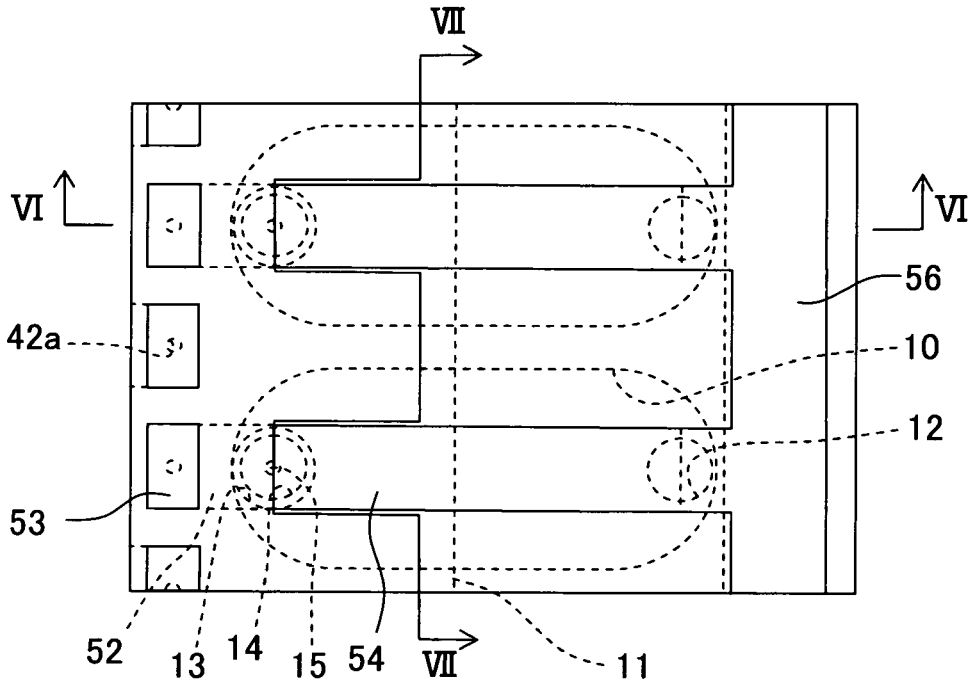
FIG. 5 is a partial enlarged view of FIG. 2.
Figure 6:
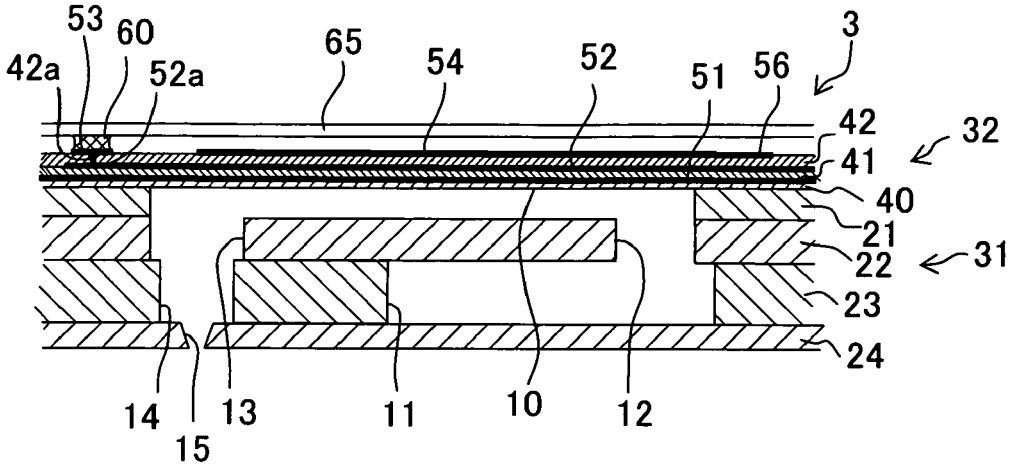
FIG. 6 is a cross-sectional view taken along line VI-VI in FIG. 5.
Figure 7:
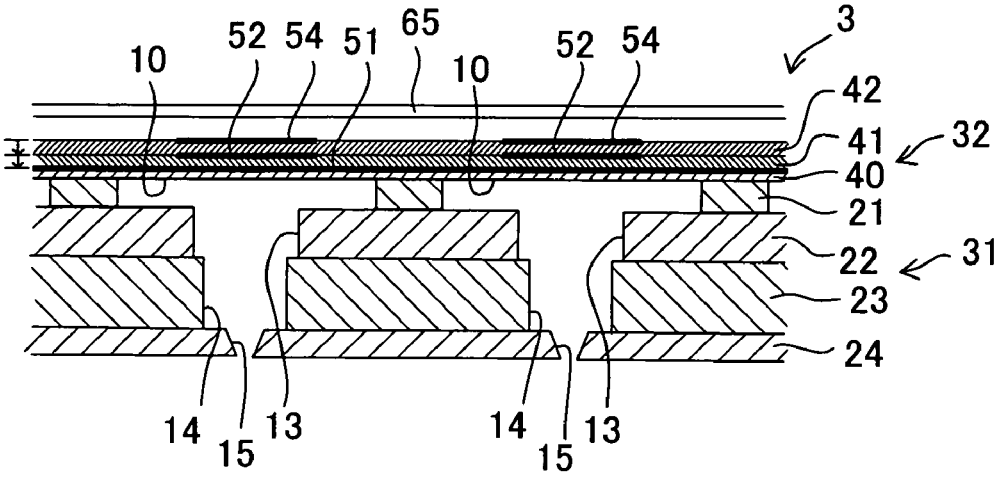
FIG. 7 is a cross-sectional view taken along line VII-VII in FIG. 5.

Next, the inkjet head 3 will be explained. FIG. 2 is a plane view of the inkjet head 3 in FIG. 1. FIG. 3 is a view of the inkjet head 3 in FIG. 2 from which a piezoelectric layer 42 (to be described later) is removed. FIG. 4 is a view of the inkjet head 3 in FIG. 2 from which piezoelectric layers 41, 42 (to be described later) are removed. FIG. 5 is a partial enlarged view of FIG. 2. FIG. 6 is a cross-sectional view taken along line VI-VI in FIG. 5. FIG. 7 is a cross-sectional view taken along line VII-VII in FIG. 5.

As shown in FIG. 2 to FIG. 7, the inkjet head 3 includes: a channel unit 31 in which ink channels (liquid transport channels) including a manifold channel 11, pressure chambers 10, and the nozzles 15 (to be described later) are formed; and a piezoelectric actuator 32 disposed on an upper surface of the channel unit 31.

The channel unit 31 is formed of four plates, that is, a cavity plate 21, a base plate 22, a manifold plate 23, and a nozzle plate 24 which are stacked in this order from the top. Among these four plates 21 to 24, the three plates 21 to 23 except the nozzle plate 24 are made of a metal material such as stainless steel, and the nozzle plate 24 is made of synthetic resin such as polyimide. Alternatively, the nozzle plate 24 may also be made of a metal material similarly to the other three plates 21 to 23.

In the cavity plate 21, the plural pressure chambers 10 are formed. In a plane view, each of the pressure chambers 10 has a substantially elliptical shape whose longitudinal direction is the scanning direction (right and left direction in FIG. 2). The pressure chambers 10 are arranged in the paper feed direction (up and down direction in FIG. 2) to form a pressure chamber row, and there are provided two such pressure chamber rows which are arranged in the scanning direction. In the base plate 22, through holes 12, 13 are provided in portions facing both ends in the scanning direction of the pressure chambers 10 respectively.

In the manifold plate 23, the manifold channel 11 is formed. The manifold channel 11 has portions extending in two rows in the paper feed direction, one of the portions facing a substantially left half of the pressure chambers 10 forming the left pressure chamber row in FIG. 2 and the other portion facing a substantially right half of the pressure chambers 10 forming the right pressure chamber row in FIG. 2, and these portions extending in two rows communicate with each other at a lower end portion in FIG. 2. The manifold channel 11 is supplied with the ink from an ink support port 9 which is formed in portions, of piezoelectric layers 41, 42 (to be described later), facing the lower end portion of the manifold channel 11 in FIG. 2. Further, in the manifold plate 23, through holes 14 are formed at positions facing the through holes 13.

In the nozzle plate 24, the nozzles 15 are formed at portions facing the through holes 14. In the channel unit 31, the manifold channel 11 communicates with the pressure chambers 10 via the through holes 12, and the pressure chambers 10 communicate with the nozzles 15 via the through holes 13, 14. Thus, in the channel unit 31, a plurality of individual ink channels extending from an outlet port of the manifold channel 11 to the nozzles 15 via the pressure chambers 10 are formed.

The piezoelectric actuator 32 includes the piezoelectric layers 41, 42, a lower electrode 51, a plurality of individual electrodes 52, a plurality of upper electrodes 54, and so on.

The piezoelectric layer 41 (first piezoelectric layer) is made of a ferroelectric, piezoelectric material which is a mixed crystal of lead titanate and lead zirconate and contains lead zirconate titanate as its major component. The piezoelectric layer 41 is arranged on an upper surface of the cavity plate 21 to cover the pressure chambers 10. Further, the piezoelectric layer 41 is polarized in a thickness direction from its upper surface toward the lower surface (from the individual electrodes 52 toward the lower electrode 51) in advance as shown by an arrow in FIG. 7.

On a lower surface of the piezoelectric layer 41 (pressure chamber 10 side surface), the lower electrode 51 made of a conductive material such as metal is formed to face the pressure chambers 10 and to extend continuously over the pressure chambers 10. In the lower electrode 51, each of portions facing the pressure chambers 10 corresponds to a first electrode according to the present invention.

On the lower surface of the piezoelectric layer 41 on which the lower electrode 51 is formed, an insulation layer 40 (cover member) is further formed to cover the whole of the lower surface. The insulation layer 40 is made of an insulative material such as synthetic resin and covers the lower electrode 51. This can prevent the ink in the pressure chambers 10 from coming into contact with the lower electrode 51 and prevents the occurrence of a problem such as the corrosion of the lower electrode 51 due to the ink in the pressure chambers 10. In this embodiment, since the insulation layer 40 is disposed on the lower surface of the piezoelectric layer 41, the piezoelectric layer 41 does not directly cover the pressure chambers 10, but the insulation layer 40 covers the pressure chambers 10 and the piezoelectric layer 41 is disposed on the upper surface of the insulation layer 40 to extend over the plural pressure chambers 10. This structure is also included in the structure, according to the present invention, where the first piezoelectric layer covers the pressure chambers. Further, in the piezoelectric layer 41, a through hole 41*a* filled with a conductive material such as metal is formed in a portion facing an upper end portion in FIG. 2 of the lower electrode 51.

On an upper surface of the piezoelectric layer 41 (between the piezoelectric layer 41 and the piezoelectric layer 42), a plurality of individual electrodes 52 (third electrodes) made of a conductive material such as metal is formed corresponding to the pressure chambers 10 respectively. In a plane view, each of the individual electrodes 52 has a substantially rectangular shape whose longitudinal direction is the scanning direction and which has a smaller area than the pressure chamber 10, and is disposed to face a substantially center portion of the pressure chamber 10. Further, a longitudinal end portion, of each of the individual electrodes 52, on the nozzle 15 side extends up to a portion not overlapping with the pressure chamber 10 in a plane view, and its tip portion is a contact point 52*a*.

Further, on the upper surface of the piezoelectric layer 41, a contact point 57 in a substantially rectangular shape whose longitudinal direction is the scanning direction in a plane view is formed in a portion overlapping with the upper end portion in FIG. 2 of the lower electrode 51 and the through hole 41*a*. The lower electrode 51 and the contact point 57 are connected to each other via the conductive material filled in the through hole 41*a*.

The piezoelectric layer 42 (second piezoelectric layer) is made of the same piezoelectric material as that of the piezoelectric layer 41, and is joined to the upper surface of the piezoelectric layer 41 (a surface opposite the pressure chambers 10). The piezoelectric layer 42 is polarized in a thickness direction from its upper surface toward the lower surface (from the upper electrodes 54 toward the individual electrodes 52) in advance as shown by the arrow in FIG. 7.

Further, in the piezoelectric layer 42, through holes 42*a* filled with a conductive material such as metal are formed in portions facing the contact points 52*a*. In the piezoelectric layer 42, a through hole 42*b* filled with a conductive material such as metal is further formed in a portion facing the contact point 57 and the through hole 41*a*.

On an upper surface of the piezoelectric layer 42 (surface opposite the piezoelectric layer 41), the upper electrodes 54 (second electrodes) made of a conductive material such as metal are formed corresponding to the pressure chambers 10 respectively. In a plane view, each of the upper electrodes 54 has a substantially rectangular shape whose longitudinal direction is the scanning direction and which has a smaller area than the pressure chamber 10, and is disposed to face the substantially center portion of the pressure chamber 10. Further, longitudinal end portions, of the upper electrodes 54, opposite to the nozzles 15 extend up to both ends in the scanning direction, which do not overlap with the pressure chambers 10, of the upper surface of the piezoelectric layer 42, in a plane view.

On the upper surface of the piezoelectric layer 42, a wiring part 56 is formed. In the wiring part 56, two portions on both end portions in the scanning direction of the upper surface of the piezoelectric layer 42 extend in the paper feed direction to connect the end portions, of the upper electrodes 54, opposite the nozzles 15. In the wiring part 56, a portion between upper end portions in FIG. 2 of the aforesaid two portions extending in the paper feed direction extends in the scanning direction to connect the aforesaid two portions.

On the upper surface of the piezoelectric layer 42, contact points 53 having a substantially rectangular shape in a plane view are further formed at positions facing the contacts 52*a* and the through holes 42*a*. The contact points 52*a* and the contact points 53 are connected via the conductive members filled in the through holes 42*a*.

In addition, on the upper surface of the piezoelectric layer 42, a contact point 55 in a substantially rectangular shape whose longitudinal direction is the scanning direction in a plane view is formed in a portion facing the contact point 57 and the through hole 42*b*. The contact point 55 and the contact point 57 are connected to each other via the through hole 42*b*, and the contact point 57 and the lower electrode 51 are connected to each other via the through hole 41*a* as described above, and consequently the contact point 55 and the lower electrode 51 are connected to each other.

Above the piezoelectric layer 42, a flexible wiring member (FPC) 65 is provided, and the FPC 65 is connected via a solder 60 to a substantially center portion of the contact point 55, the contact points 53, and a substantially center portion of the portion, of the wiring part 56, extending in the scanning direction. The FPC 65 is connected to a driver IC 70 (potential applying mechanism) to be described later, and the driver IC 70 keeps the lower electrode 51 at a ground potential (first potential) and keeps the upper electrodes 54 at a predetermined positive potential (second potential higher than the first potential, for example, 20 V), and selectively applies one of the ground potential and the predetermined positive potential individually to the individual electrodes 52. That is, the driver IC 70 can apply the potentials individually to the lower electrode 51, the individual electrodes 52, and the upper electrodes 54 respectively. In other words, the driver IC 70 serves as a potential applying mechanism capable of applying an electric field in the thickness direction selectively to portions, of the piezoelectric layer 41 and the piezoelectric layer 42, facing the pressure chambers 10, as will be described later.

Here, the lower electrode 51 is formed on the lower surface of the piezoelectric layer 41, and the individual electrodes 52 are formed on the upper surface of the piezoelectric layer 41, which means that the lower electrode 51 and the individual electrodes 52 are not formed on the upper surface of the piezoelectric layer 42. Therefore, when the FPC 65 is connected to the lower electrode 51 (contact point 55) and the individual electrodes 52 (contact points 53) by the solder 60, the solder 60 does not flow into the upper surfaces of the lower electrode 51 and the individual electrodes 52.

Further, though the upper electrodes 54 are formed on the upper surface of the piezoelectric layer 42, in the wiring part 56 connected to the upper electrodes 54, the portion to which the FPC 65 is connected is apart from the upper electrodes 54. Therefore, when the FPC 65 and the wiring part 56 are connected by the solder 60, the solder 60 does not flow into upper surfaces of the upper electrodes 54.

With this structure, it is prevented that, when the piezoelectric actuator 32 is driven as will be described later, the solder 60 to adhere to the upper surfaces of the lower electrode 51, the individual electrodes 52, and the upper electrodes 54 to change a deformation characteristic of the piezoelectric layers 41, 42 and accordingly an ink jetting characteristic of the nozzles 15 to be changed.

Figure 8:
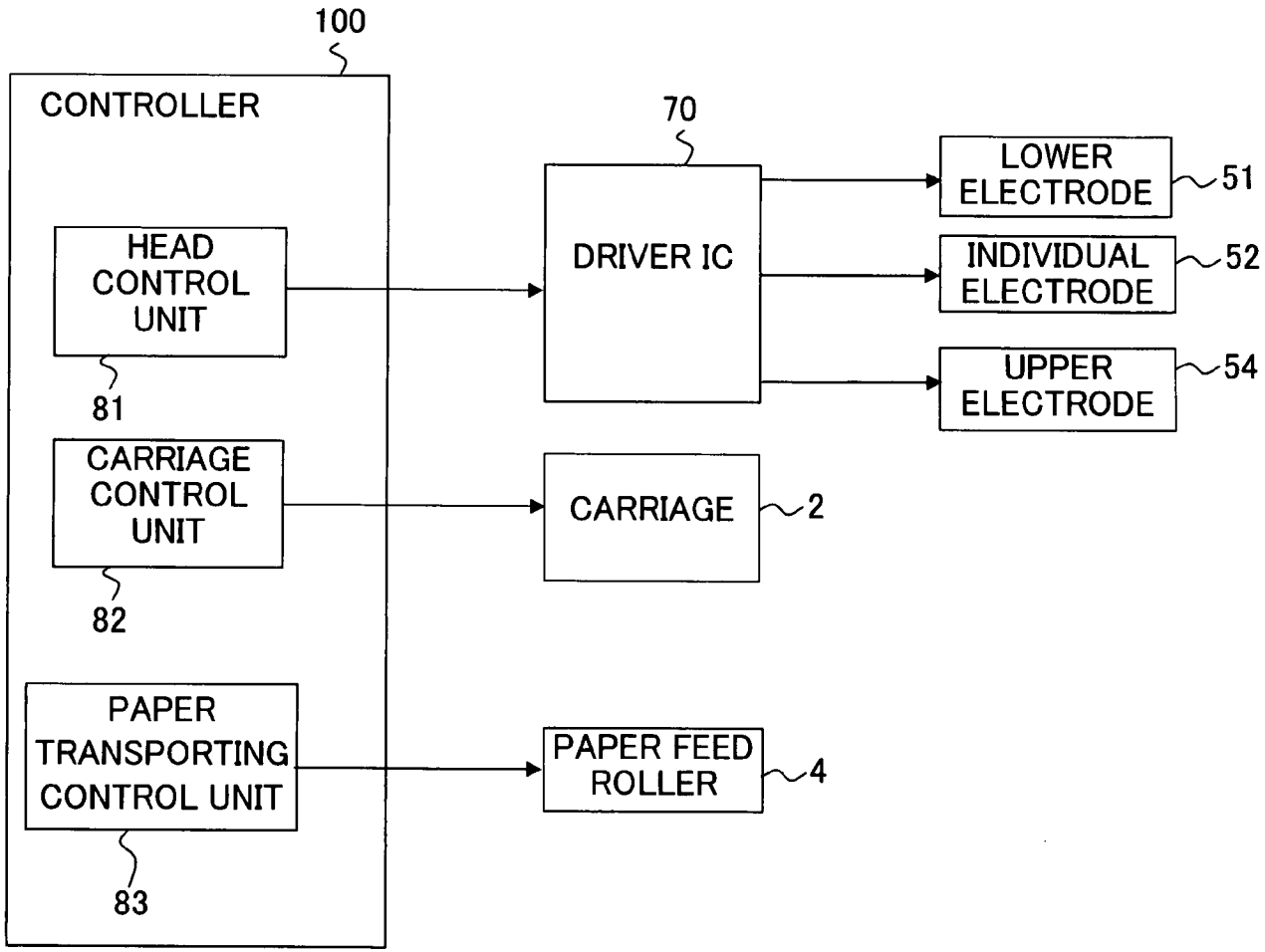
FIG. 8 is a block diagram of a control device in FIG. 1.

Next, a control device 100 controlling the operation of the printer 1 will be described. FIG. 8 is a block diagram of the control device 100. The control device 100 includes a CPU (Central Processing Unit), a ROM (Read Only Memory), a RAM (Random Access Memory), and so on, and they operate as a head control unit 81, a carriage control unit 82, and a paper transporting control unit 83 which will be explained below.

The head control unit 81 controls the operation of the inkjet head 3. Concretely, the head control unit 81 controls the potentials applied by the driver IC 70 to the lower electrode 51, the individual electrodes 52, and the upper electrodes 54, in other words, it controls the electric field applied by the driver IC 70 to the piezoelectric layer 41 and the piezoelectric layer 42, thereby controlling the operation of the piezoelectric actuator 32 as will be described later. The carriage control unit 82 controls the reciprocation of the carriage 2. The paper transporting control unit 83 controls the paper feed roller 4 when the paper feed roller 4 transports the recording paper P. The head control unit 81 corresponds to a controller according to the present invention, and the combination of the head control unit 81 and the aforesaid driver IC 70 corresponds to a driving mechanism according to the present invention.

Figure 9A:
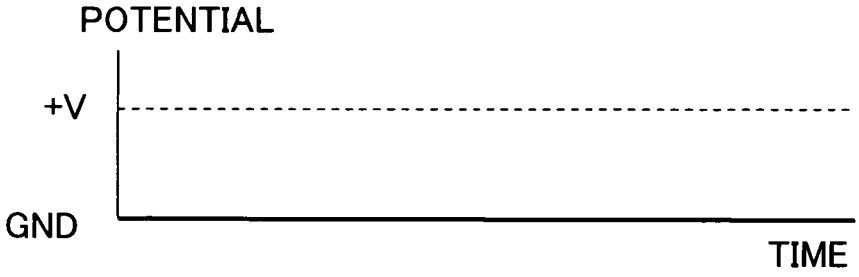
FIG. 9A to FIG. 9C are charts showing a change in potentials of electrodes when a piezoelectric actuator is driven.
Figure 9B:
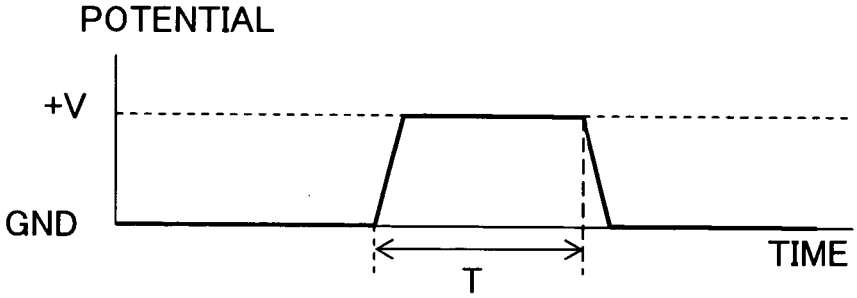
Figure 9C:
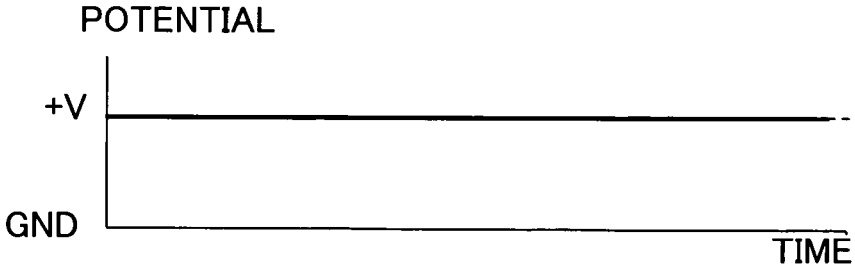
Figure 10A:
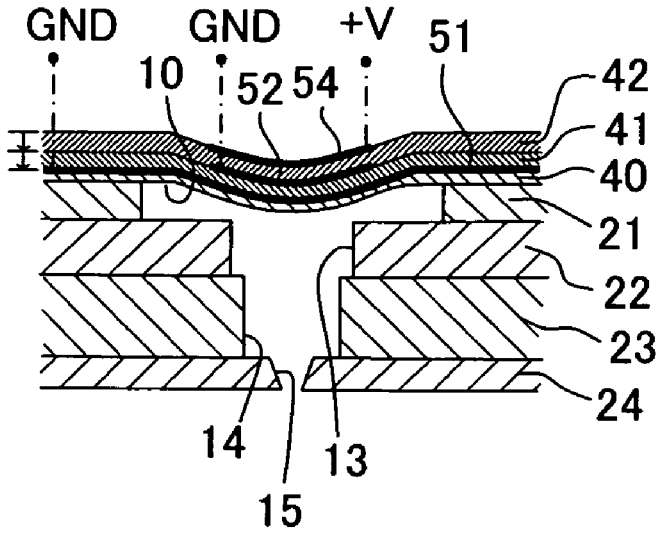
FIG. 10A and FIG. 10B are views showing states of the inkjet head when the piezoelectric actuator is driven.
Figure 10B:
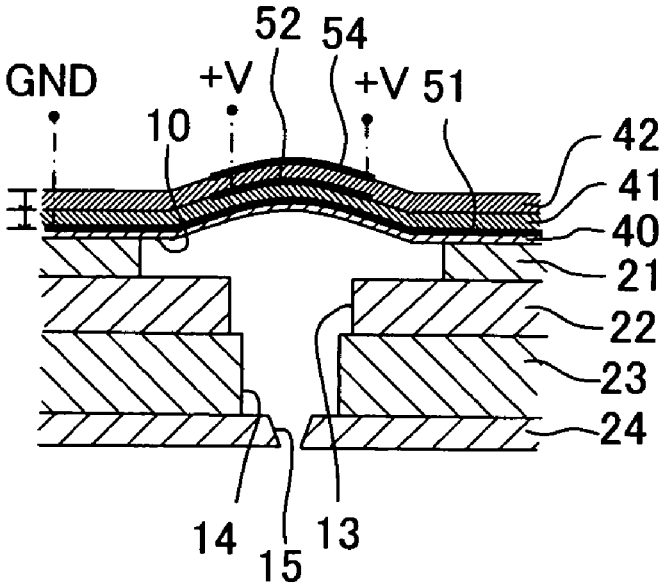

Here, a method for driving the piezoelectric actuator 32 will be explained. FIG. 9A to FIG. 9C are charts showing how the potentials of the lower electrode 51, the individual electrodes 52, and the upper electrodes 54 change when the piezoelectric actuator 32 is driven. FIG. 9A shows the potential of the lower electrode 51, FIG. 9B shows the potential of the individual electrodes 52, and FIG. 9C shows the potential of the upper electrodes 54. FIG. 10A and FIG. 10B are views showing states of the inkjet head 3 when the piezoelectric actuator 32 is driven. The piezoelectric actuator 32 is driven as will be explained below when the driver IC 70 controlled by the head control unit 81 applies the potentials to the lower electrode 51, the individual electrodes 52, and the upper electrodes 54.

As previously described, in this embodiment, the lower electrode 51 is kept at the ground potential (represented by "GND" in FIG. 9A to FIG. 9C) and the upper electrodes 54 are kept at the predetermined positive potential (represented by "+V" in FIG. 9A to FIG. 9C), as shown in FIG. 9A to FIG. 9C. When the piezoelectric actuator 32 is not driven, the individual electrodes 52 are kept at the ground potential (in a second state) as shown in FIG. 9B. In this state, as shown in FIG. 9B and FIG. 9C, the individual electrodes 52 and the upper electrodes 54 have a potential difference, and due to this potential difference, an electric field in the thickness direction from the upper electrodes 54 toward the individual electrodes 52 is generated in portions, of the piezoelectric layer 42, sandwiched by the individual electrodes 52 and the upper electrodes 54 (the electric field in the thickness direction is applied to the portions, of the piezoelectric layer 42, facing the pressure chambers 10). Since the direction of the electric field matches the polarization direction of the piezoelectric layer 42, these portions of the piezoelectric layer 42 contract in a horizontal direction perpendicular to the polarization direction (become an active layer). On the other hand, since the lower electrode 51 and the individual electrodes 52 are at the same potential, no electric field is generated in portions, of the piezoelectric layer 41, sandwiched by the lower electrode 51 and the individual electrodes 52 (no electric field in the thickness direction is applied to the portions, of the piezoelectric layer 41, facing the pressure chambers 10), these portions do not contract unlike the piezoelectric layer 42 (become an inactive layer). Consequently, the portions, of the piezoelectric layers 41, 42, facing the pressure chambers 10 are deformed as a whole so as to project toward the pressure chamber 10 side.

To cause the nozzle 15 to jet the ink, the potential of the individual electrode 52 is first switched from the ground potential to the predetermined positive potential as shown in FIG. 9B (switched to a first state). As a result, a potential difference occurs between the individual electrode 52 and the lower electrode 51, and due to this potential difference, an electric field in the thickness direction from the individual electrode 52 toward the lower electrode 51 is generated in a portion, of the piezoelectric layer 41, sandwiched by the individual electrode 52 and the lower electrode 51 (the electric field in the thickness direction is applied to the portion, of the piezoelectric layer 41, facing the pressure chamber 10), as shown in FIG. 10B. Since the direction of the electric field matches the polarization direction of the piezoelectric layer 41, this portion of the piezoelectric layer 41 contracts in the horizontal direction perpendicular to the polarization direction (becomes an active layer). On the other hand, since the upper electrode 54 and the individual electrode 52 are at the same potential, no electric field is generated in the portion, of the piezoelectric layer 42, sandwiched by the upper electrode 54 and the individual electrode 52 (no electric field in the thickness direction is applied to the portion, of the piezoelectric layer 41, facing the pressure chamber 10), this portion does not contract unlike the piezoelectric layer 41 (become an inactive layer). Consequently, the portions, of the piezoelectric layers 41, 42, facing the pressure chamber 10 are deformed as a whole so as to project toward an opposite side of the pressure chamber 10, resulting in an increase in the volume of the pressure chamber 10. Accordingly, the pressure of the ink in the pressure chamber 10 is decreased, and consequently, the ink flows into the pressure chamber 10 from the manifold channel 11.

After a predetermined time T passes, the potential of the individual electrode 52 is returned from the predetermined positive potential to the ground potential (changed to the second state), as shown in FIG. 9B. Consequently, the piezoelectric layers 41, 42 are deformed again so as to project toward the pressure chamber 10 side as shown in FIG. 10A, resulting in a decrease in the volume of the pressure chamber 10. Accordingly, the pressure of the ink in the pressure chamber 10 increases (the pressure is applied to the ink in the pressure chamber 10), and the nozzle 15 communicating with the pressure chamber 10 jets the ink (the liquid is transported in the liquid transport channel).

As described above, by switching the state of the piezoelectric actuator 32 between the aforesaid first state and second state, or in another point of view, by applying the electric field in the thickness direction selectively to the portions, of the piezoelectric layer 41 and the piezoelectric layer 42, facing the pressure chamber 10, it is possible to make the portions, of the piezoelectric layers 41, 42, facing the pressure chamber 10 deform so as to project toward the pressure chamber 10 side and toward the opposite side of the pressure chamber 10. That is, the piezoelectric layers 41, 42 can be greatly deformed. Therefore, as described above, since the piezoelectric layers 41, 42 are deformed in advance so as to project toward the pressure chamber 10 side and then the piezoelectric layers 41, 42 are deformed once so as to project toward the opposite side of the pressure chamber 10 and thereafter are deformed so as to project toward the pressure chamber 10 side again, it is possible to greatly change the volume of the pressure chamber 10. As a result, a high pressure can be applied to the ink in the pressure chamber 10. This enables the ink to be jetted from the nozzles 15 efficiently.

Further, by switching the potential of the individual electrode 52 between the ground potential and the predetermined positive potential while keeping the lower electrode 51 at the ground potential and keeping the upper electrodes 54 at the predetermined positive potential, it is possible to drive the piezoelectric actuator 52, and therefore, the control for driving the piezoelectric actuator 32 can be simple. Further, since the lower electrode 51 can be formed as one electrode disposed to extend over the plural pressure chambers 10 and there is no need to provide individual wirings for the upper electrodes 54, it is possible to simplify the structure of the wiring connected to the lower electrode 51 and the upper electrodes 54.

Further, since the directions of the electric fields generated in the piezoelectric layers 41, 42 match the polarization directions of the piezoelectric layers 41, 42, the polarizations in the thickness direction of the piezoelectric layers 41, 42 are not weakened.

According to the embodiment explained above, by setting the individual electrodes 52 at the ground potential while keeping the lower electrode 51 at the ground potential and keeping the upper electrodes 54 at the predetermined positive potential, in other words, by applying the electric field in the thickness direction to the portions, of the piezoelectric layer 42, facing the pressure chambers 10 and applying no electric field in the thickness direction to the portions, of the piezoelectric layer 41, facing the pressure chambers 10, it is possible to make the portions, of the piezoelectric layers 41, 42, facing the pressure chambers 10 deform so as to project toward the pressure chamber 10 side. Moreover, by setting the individual electrode 52 at the predetermined positive potential, in other words, by applying the electric field in the thickness direction to the portion, of the piezoelectric layer 41, facing the pressure chamber 10 and applying no electric field in the thickness direction to the portion, of the piezoelectric layer 42, facing the pressure chamber 10, it is possible to make the portions, of the piezoelectric layers 41, 42, facing the pressure chamber 10 deform so as to project toward the opposite side of the pressure chamber 10. Consequently, it is possible to greatly change the volume of the pressure chamber 10 to apply a high pressure to the ink in the pressure chamber 10.

Further, in order to drive the piezoelectric actuator 32, it is only necessary to switch the potential of the individual electrode 52 between the ground potential and the predetermined positive potential while keeping the lower electrode 51 at the ground potential and keeping the upper electrodes 54 at the predetermined positive potential, and therefore, the piezoelectric actuator 32 can be easily driven. Further, the lower electrode 51 can be formed as one electrode extending over the plural pressure chambers 10 and there is no need to separately provide wirings for the respective upper electrodes 54, the wiring connected to the lower electrode 51 and the upper electrodes 54 can be simplified.

Further, when the individual electrode 52 is set at the ground potential, the electric field from the upper electrode 54 toward the individual electrode 52 is generated, and the direction of the electric field matches the polarization direction of the piezoelectric layer 42. On the other hand, when the individual electrode 52 is set at the predetermined positive potential, the electric field from the individual electrode 52 toward the lower electrode 51 is generated and the direction of the electric field matches the polarization direction of the piezoelectric layer 41. Therefore, the electric field generated due to the potential difference among the lower electrode 51, the individual electrode 52, and the upper electrode 54 does not weaken the polarizations in the thickness direction of the piezoelectric layers 41, 42.

Further, since the insulation layer 40 covering the lower electrode 51 is formed on the lower surface of the piezoelectric layer 41, the lower electrode 51 does not come into contact with the ink in the pressure chambers 10, which prevents the lower electrode 51 from being corroded by the ink in the pressure chambers 10.

Next, modified examples in which various changes are made in this embodiment will be described. The same reference numerals and symbols are used to designate portions having the same structures as those of this embodiment, and explanation thereof will be omitted when appropriate.

Figure 11A:
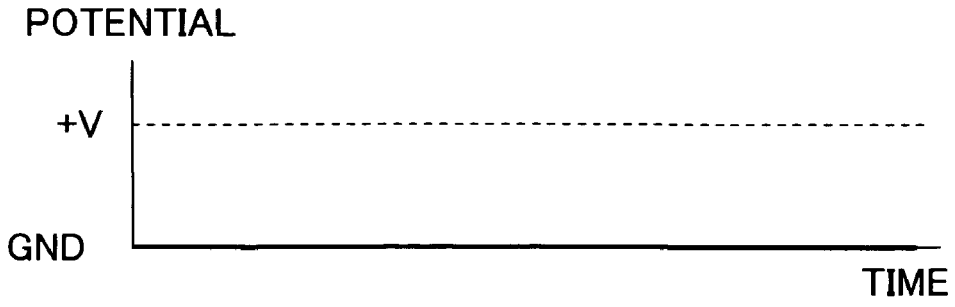
FIG. 11A to FIG. 11C are charts corresponding to FIG. 9A to FIG. 9C, of a modified example 1.
Figure 11B:
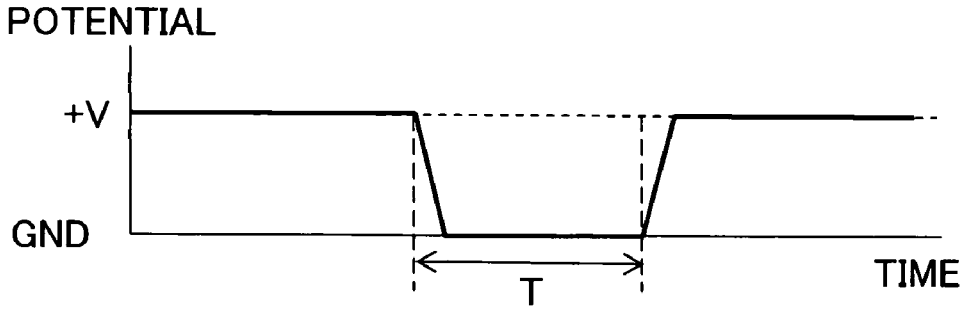
Figure 11C:
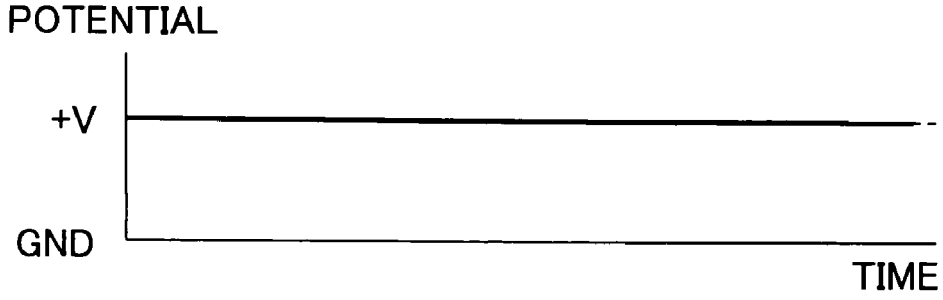

The method for diving the piezoelectric actuator 32 is not limited to that of the embodiment. For example, in one modified example, in the piezoelectric actuator 32, the individual electrodes 52 are kept at the predetermined positive potential (in the first state) in advance as shown in FIG. 11B, in other words, the electric field in the thickness direction is applied to the portions, of the piezoelectric layer 41, facing the pressure chambers 10 and no electric field in the thickness direction is applied to the portions, of the piezoelectric layer 42, facing the pressure chambers 10, thereby making the piezoelectric layers 41, 42 deform so as to project toward the opposite side of the pressure chambers 10 as shown in FIG. 10B. Then, from this state, the potential of the individual electrode 52 is switched to the ground potential (switched to the second state) as shown in FIG. 11B, in other words, the electric field in the thickness direction is applied to a portion, of the piezoelectric layer 42, facing the pressure chamber 10 and no electric field in the thickness direction is applied to a portion, of the piezoelectric layer 41, facing the pressure chambers 10, thereby making the piezoelectric layers 41, 42 deform so as to project toward the pressure chamber 10 side as shown in FIG. 10A. Consequently, the pressure of the ink in the pressure chamber 10 is increased to cause the ink to be jetted from the nozzle 15 (modified example 1). In this case, the potential of the individual electrode 52 is returned to the predetermined positive potential after a predetermined time T passes after the potential of the individual electrode 52 is switched to the ground potential.

Also in this case, when the potential of the individual electrode 52 is switched from the predetermined positive potential to the ground potential, the piezoelectric layers 41, 42 are changed from the state in which they are deformed so as to project toward the opposite side of the pressure chamber 10 into the state in which they are deformed so as to project toward the pressure chamber 10 side. Therefore, a change amount of the volume of the pressure chamber 10 is large, and a high pressure can be applied to the ink in the pressure chamber 10. This enables the ink to be jetted from the nozzle 15 efficiently.

Figure 12A:
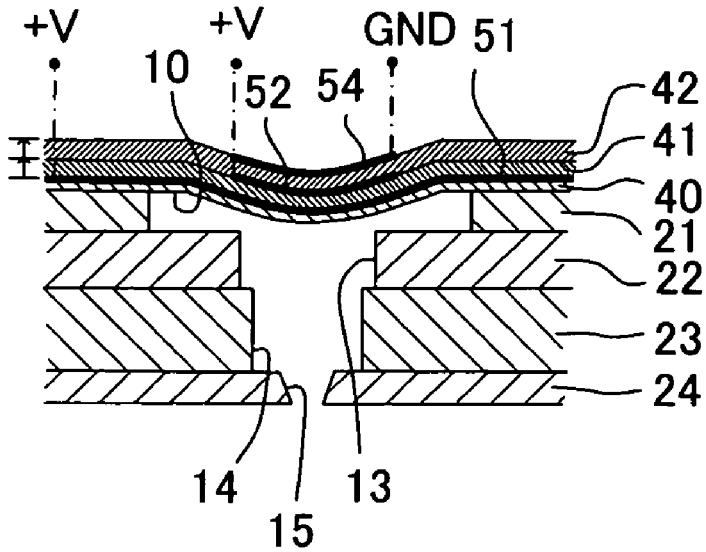
FIG. 12A and FIG. 12B are cross-sectional views corresponding to FIG. 10A and FIG. 10B, of a modified example 2.
Figure 12B:
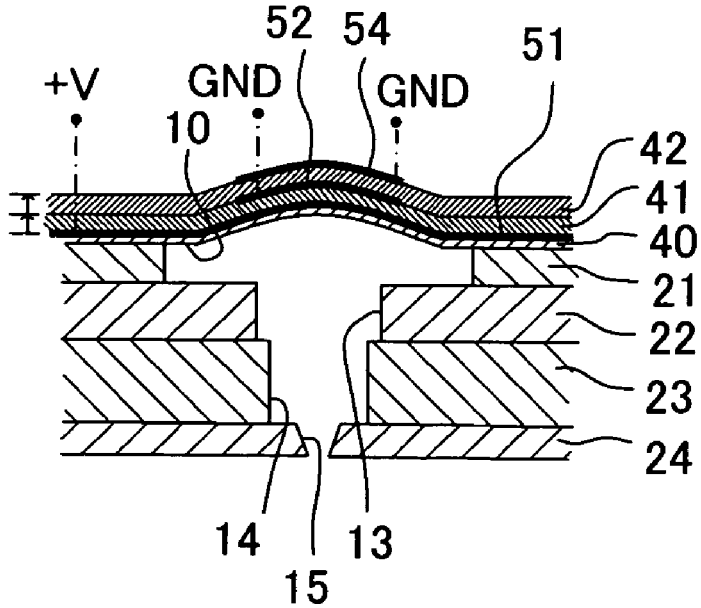
Figure 13A:
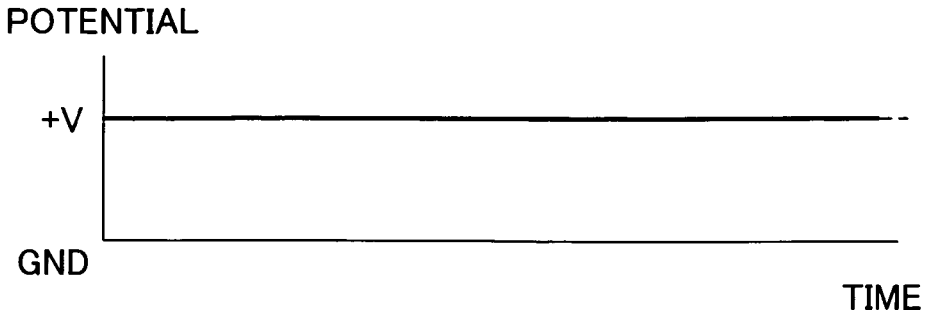
FIG. 13A to FIG. 13C are charts corresponding to FIG. 9A to FIG. 9C, of the modified example 2.
Figure 13B:
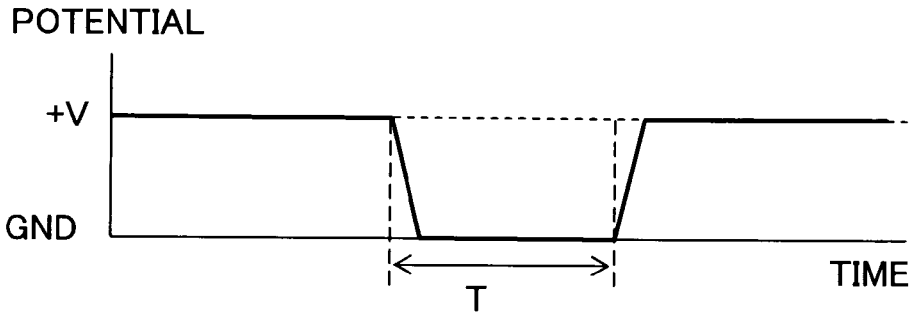
Figure 13C:
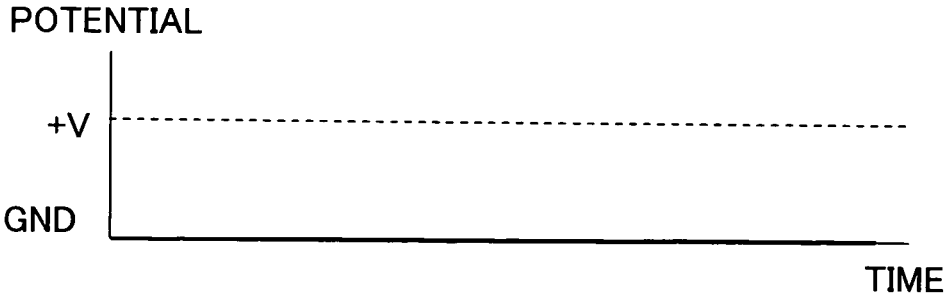

Further, in this embodiment, the lower electrode 51 is constantly kept at the ground potential and the upper electrodes 54 are constantly kept at the predetermined positive potential, but this is not restrictive. In another modified example, the piezoelectric layer 41 is polarized in the direction from the lower electrode 51 toward the individual electrodes 52 and the piezoelectric layer 42 is polarized in the direction from the individual electrodes 52 toward the upper electrodes 54, as shown by the arrows in FIG. 12A and FIG. 12B. That is, the piezoelectric layers 41, 42 are polarized in the opposite directions to those of the embodiment. As shown in FIG. 13A to FIG. 13C, the lower electrode 51 is constantly kept at the predetermined positive potential (first potential) and the upper electrodes 54 are constantly kept at the ground potential (second potential lower than the first potential), and when the nozzles 15 do not jet the ink, the individual electrodes 52 are kept at the predetermined positive potential (in the second state). In other words, the electric field in the thickness direction is applied to the portions, of the piezoelectric layer 42, facing the pressure chambers 10 and no electric field in the thickness direction is applied to the portions, of the piezoelectric layer 41, facing the pressure chambers 10. Consequently, as shown in FIG. 12A, the portions, of the piezoelectric layers 41, 42, facing the pressure chambers 10 are deformed as a whole so as to project toward the pressure chamber 10 side (modified example 2).

In this case, in order to cause the ink to be jetted from the nozzle 15, the potential of the individual electrode 52 is switched from the predetermined positive potential to the ground potential (switched to the first state) as shown in FIG. 13B, in other words, the electric field in the thickness direction is applied to a portion, of the piezoelectric layer 41, facing the pressure chamber 10, and no electric field in the thickness direction is applied to the portion, of the piezoelectric layer 42, facing the pressure chamber 10. Accordingly, the portions, of the piezoelectric layers 41, 42, facing the pressure chamber 10 are deformed as a whole so as to project toward the opposite side of the pressure chamber 10 as shown in FIG. 12B. Thereafter, when a predetermined time T has passed, the potential of the individual electrode 52 is returned from the ground potential to the predetermine positive potential (switched to the second state), in other words, the electric field in the thickness direction is applied to the portion, of the piezoelectric layer 42, facing the pressure chamber 10 and no electric field in the thickness direction is applied to the portion, of the piezoelectric layer 41, facing the pressure chamber 10. Accordingly, the portions, of the piezoelectric layers 41, 42, facing the pressure chamber 10 are deformed as a whole so as to project toward the pressure chamber 10 side as shown in FIG. 12A, thereby causing the ink to be jetted from the nozzle 15.

As described above, also in the modified example 2, the portions, of the piezoelectric layers 41, 42, facing the pressure chamber 10 can be deformed so as to project toward the pressure chamber 10 side and toward the opposite side of the pressure chamber 10, that is, the piezoelectric layers 41, 42 can be greatly deformed, which makes it possible to cause the ink to be jetted from the nozzle 15 efficiently as in the embodiment.

Also in this case, since the directions of the electric fields generated in the piezoelectric layers 41, 42 match the polarization directions of the piezoelectric layers 41, 42 respectively, the polarizations in the thickness direction of the piezoelectric layers 41, 42 are not weakened.

Moreover, in this case, since the lower electrode 51 is kept at the predetermined positive potential, if the lower electrode 51 is exposed to the pressure chambers 10, there is a risk that the potential of the lower electrode 51 causes electrolysis of the ink in the pressure chambers 10, but as in the embodiment, owing to the insulation layer 40 covering the lower electrode 51, the occurrence of the electrolysis of the ink in the pressure chambers 10 is prevented.

Figure 14:
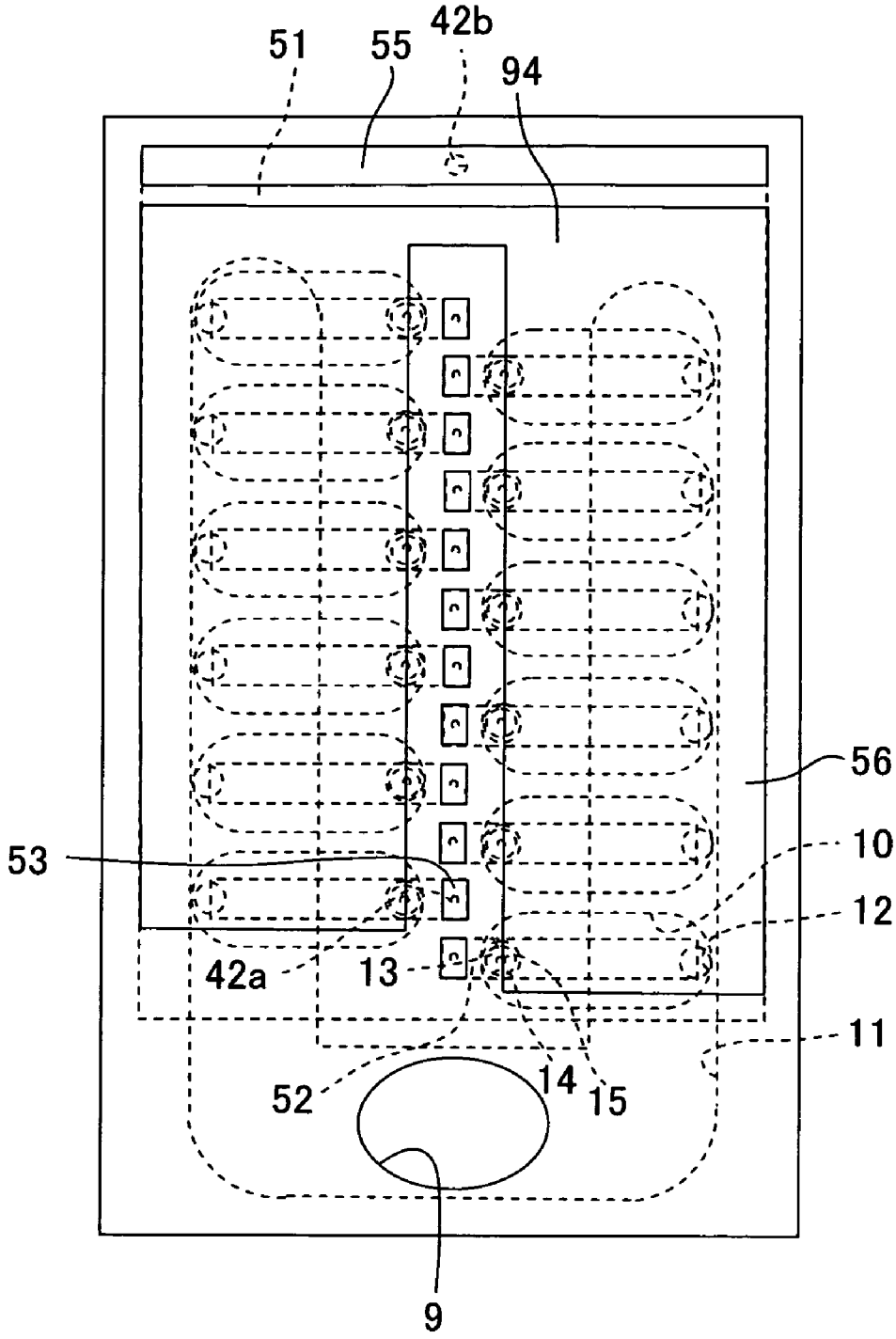
FIG. 14 is a view corresponding to FIG. 2, of a modified example 3.

Moreover, in this embodiment, the upper electrodes 54 are provided corresponding to the pressure chambers 10 respectively and the upper electrodes 54 are in electrical continuity with one another by the wiring part 56, but this is not restrictive. In another modified example, as shown in FIG. 14, on the upper surface of the piezoelectric layer 42, one upper electrode 94 is disposed continuously over portions facing the pressure chambers 10 so as not to overlap with the contact points 53, 55 (modified example 3). In this case, in the upper electrode 94, each of portions facing the pressure chambers 10 corresponds to the second electrode according to the present invention, and the second electrodes are also kept at the predetermined positive potential when the upper electrode 94 is kept at the predetermined potential.

Figure 15:
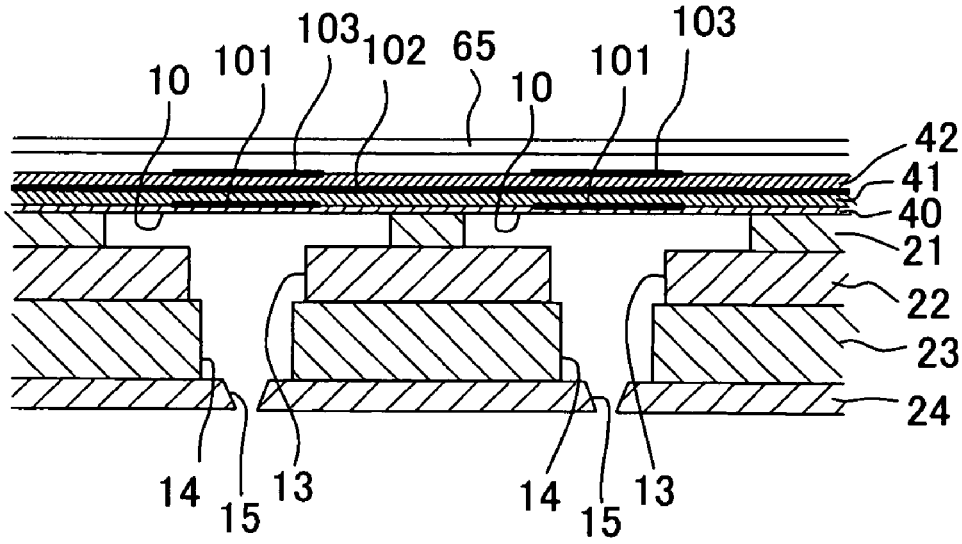
FIG. 15 is a cross-sectional view corresponding to FIG. 7, of a modified example 4.

The arrangement of the electrodes is not limited to that of the embodiment. For example, in another modified example, as shown in FIG. 15, a plurality of individual electrodes 101 (first electrodes) are formed on portions, of the lower surface of the piezoelectric layer 41, facing the pressure chambers 10, a common electrode 102 is formed between the piezoelectric layer 41 and the piezoelectric layer 42 to extend over the whole areas thereof, and a plurality of upper electrodes 103 (second electrodes) are formed on portions, of the upper surface of the piezoelectric layer 42, facing the pressure chambers 10. The common electrode 102 is constantly kept at the ground potential, and driving potentials are applied individually to the individual electrodes 101 and the upper electrodes 103 (modified example 4).

Figure 17A:
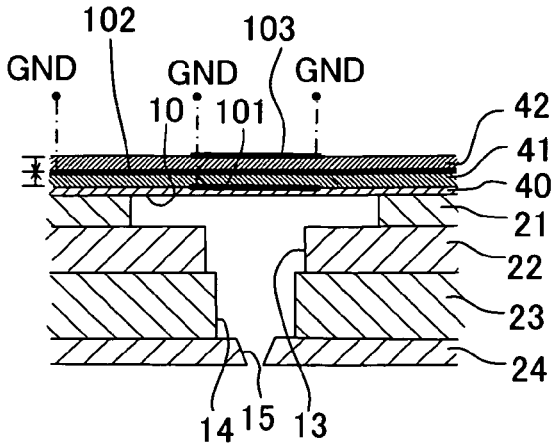
FIG. 17A to FIG. 17C are cross-sectional views corresponding to FIG. 10A and FIG. 10B, of the modified example 4.
Figure 17B:
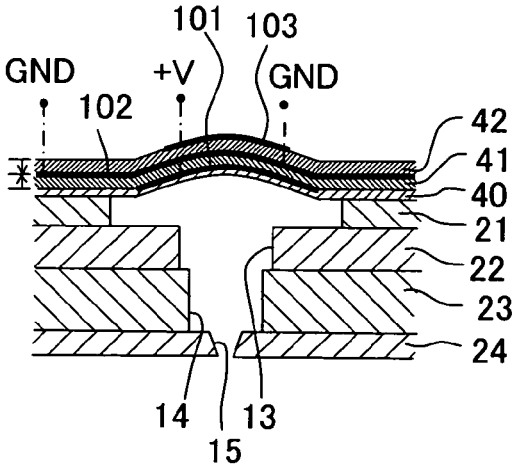
Figure 17C:
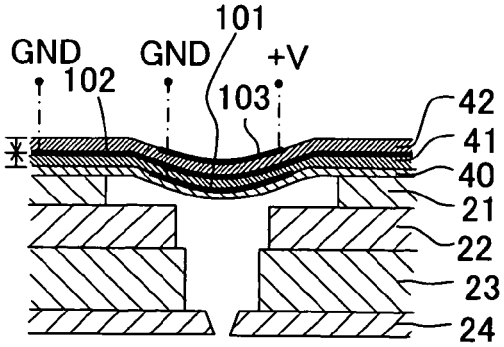

Further, in the modified example 4, the piezoelectric layer 41 is polarized in the thickness direction from its lower surface toward upper surface and the piezoelectric layer 42 is polarized in the thickness direction from its upper surface toward lower surface as shown by the arrows in FIG. 17A to FIG. 17C. In the common electrode 102, each portion facing the pressure chamber 10 corresponds to the third electrode according to the present invention.

Figure 16A:
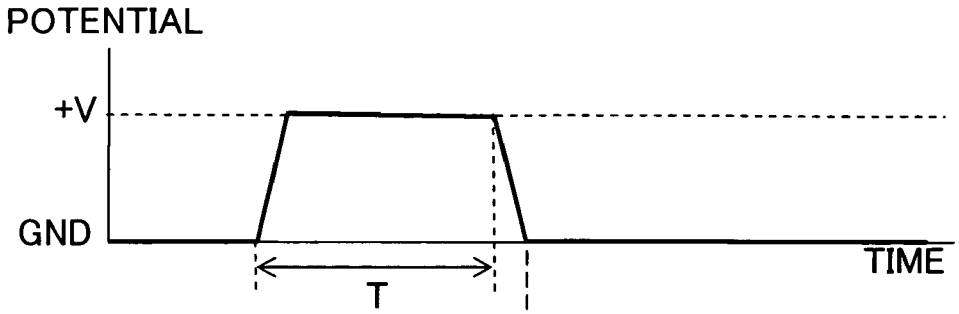
FIG. 16A to FIG. 16C are charts corresponding to FIG. 9A to FIG. 9C, of the modified example 4.
Figure 16B:
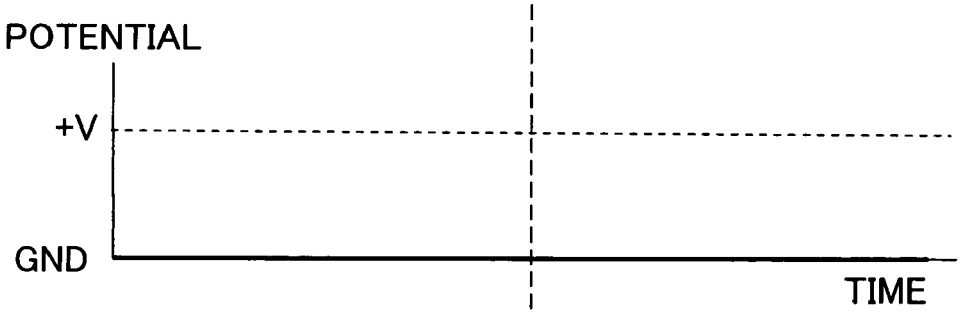
Figure 16C:
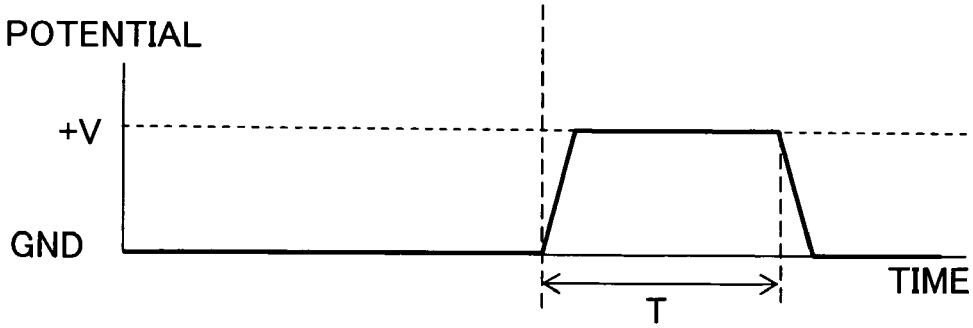

FIG. 16A to FIG. 16C are charts showing a change in the potentials of the common electrode 102, the individual electrodes 101, and the upper electrodes 103 when the piezoelectric actuator is driven in the modified example 4. FIG. 16A shows the change in the potential of the individual electrodes 101, FIG. 16B shows the change in the potential of the common electrode 102, and FIG. 16C shows the change in the potential of the upper electrodes 103. FIG. 17A to FIG. 17C are views showing states of the inkjet head when the piezoelectric actuator is driven in the modified example 4.

In the modified example 4, when the ink is not jetted from the nozzles 15, the individual electrodes 101 and the upper electrodes 103 are both kept at the ground potential as shown in FIG. 16A and FIG. 16C. In this state, no electric field in the thickness direction is generated in the piezoelectric layers 41, 42, and the piezoelectric layers 41, 42 are not deformed as shown in FIG. 17A.

In order to cause the ink to be jetted from the nozzle 15, the potential of the individual electrode 101 is first switched from the ground potential to the predetermined positive potential (switched to the first state) as shown in FIG. 16A. At this time, the potential of the upper electrode 103 is kept at the ground potential. Consequently, a potential difference occurs between the individual electrode 101 and the common electrode 102, and an electric field in the direction matching the polarization direction of the piezoelectric layer 41, that is, in the direction from the individual electrode 101 toward the common electrode 102, is generated in a portion, of the piezoelectric layer 41, sandwiched by the individual electrode 101 and the common electrode 102 (the electric field in the thickness direction is applied to the portion, of the piezoelectric layer 41, facing the pressure chamber 10). On the other hand, since the upper electrodes 103 and the common electrode 102 are at the same potential, no electric field is generated in the piezoelectric layer 42 (no electric field in the thickness direction is applied to the portions, of the piezoelectric layer 42, facing the pressure chambers 10). Therefore, as in the embodiment, the portions, of the piezoelectric layers 41, 42, facing the pressure chamber 10 are deformed as a whole so as to project toward the opposite side of the pressure chamber 10, resulting in an increase in the volume of the pressure chamber 10. Accordingly, the pressure of the ink in the pressure chamber 10 lowers, and the ink flows into the pressure chamber 10 from the manifold channel 11.

Then, after a predetermined time T passes, the potential of the individual electrode 101 is switched from the predetermined positive potential to the ground potential, and the potential of the upper electrode 103 is switched from the ground potential to the predetermined positive potential (switched to the second state) at an instant when the potential of the individual electrode 101 becomes the ground potential, as shown in FIG. 16A and FIG. 16C. Consequently, a potential difference occurs between the upper electrode 103 and the common electrode 102, and the electric field in the direction matching the polarization direction of the piezoelectric layer 42, that is, in the direction from the individual electrode 103 toward the common electrode 102 is generated in the portion, of the piezoelectric layer 41, sandwiched by the individual electrode 103 and the common electrode 102 (the electric field in the thickness direction is applied to the portion, of the piezoelectric layer 42, facing the pressure chamber 10), as shown in FIG. 17C. On the other hand, since the individual electrodes 101 and the common electrode 102 are at the same potential, no electric field is generated in the piezoelectric layer 41 (no electric field in the thickness direction is applied to the portions, of the piezoelectric layer 41, facing the pressure chambers 10). Therefore, as in the embodiment, the portions, of the piezoelectric layers 41, 42, facing the pressure chamber 10 are deformed as a whole so as to project toward the pressure chamber 10 side, resulting in a decrease in the volume of the pressure chamber 10. Consequently, the pressure of the ink in the pressure chamber 10 increases, and the ink is jetted from the nozzle 15 communicating with the pressure chamber 10.

Also in this case, since the portions, of the piezoelectric layers 41, 42, facing the pressure chamber 10 can be deformed so as to project toward the pressure chamber 10 and toward the opposite side of the pressure chamber 10, a high pressure can be applied to the ink in the pressure chamber 10. This enables the ink to be jetted from the nozzle 15 efficiently.

Also in this case, since the directions of the electric fields generated in the piezoelectric layers 41, 42 match the polarization directions of the piezoelectric layers 41, 42 respectively, the polarizations in the thickness direction of the piezoelectric layers 41, 42 are not weakened.

Figure 18:
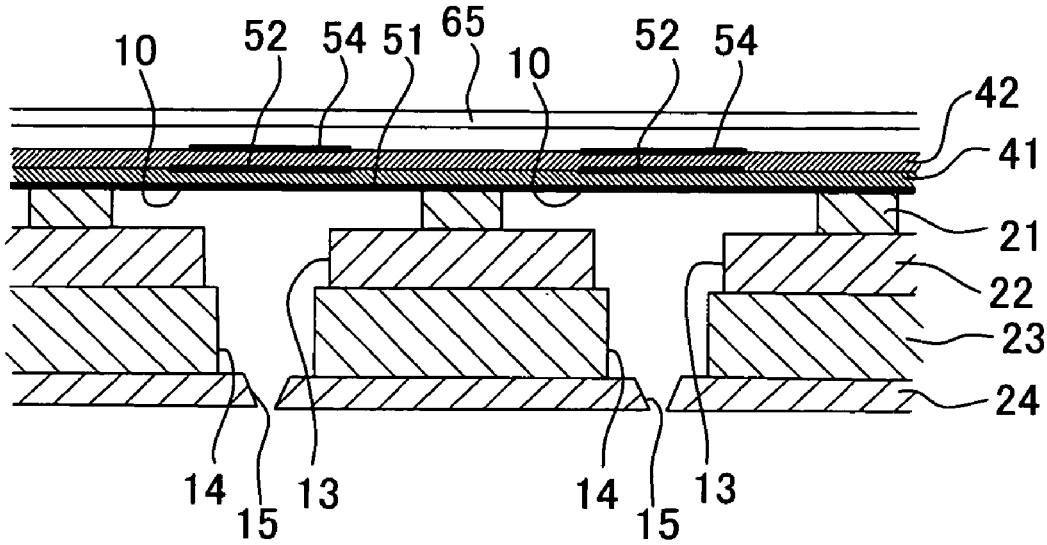
FIG. 18 is a cross-sectional view corresponding to FIG. 7, of a modified example 5.

Further, in this embodiment, the insulation layer 40 is disposed on the lower surface of the piezoelectric layer 41 and the insulation layer 40 prevents the lower electrode 51 from coming into contact with the ink in the pressure chambers 10, but the structure without the insulation layer 40 as shown in FIG. 18 is also adoptable (modified example 5). In this case, the lower electrode 51 is in contact with the ink in the pressure chambers 10, and if the lower electrode 51 is kept at the predetermined positive potential as in the modified example 2, electrolysis of the ink in the pressure chambers 10 may possibly occur due to the potential of the lower electrode 51, and therefore, it is preferable to constantly keep the lower electrode 51 at the ground potential as in the embodiment.

In the foregoing explanation, the polarization directions of the piezoelectric layers 41, 42 match the directions of the electric fields generated in the piezoelectric layers 41, 42 respectively, but the polarization directions of the piezoelectric layers 41, 42 and the directions of the electric fields generated in (applied to) the piezoelectric layers 41, 42 may be opposite. In this case, when the electric field is generated in (applied to) the piezoelectric layer 41, the portion, of the piezoelectric layer 41, facing the pressure chamber 10 expands in the horizontal direction, and accordingly, the portions, of the piezoelectric layer 41 and the piezoelectric layer 42, facing the pressure chamber 10 are deformed as a whole so as to project toward the pressure chamber 10 side, and when the electric field is generated in (applied to) the piezoelectric layer 42, the portion, of the piezoelectric layer 42, facing the pressure chamber 10 expands in the horizontal direction as a whole so as to project toward the opposite side of the pressure chamber 10. That is, the piezoelectric layers 41, 42 are deformed in the opposite direction to that in the embodiment. In this case, however, the predetermined positive potential applied to the individual electrode 52 and the upper electrode 54 is preferably a low potential in order to prevent the polarizations in the thickness direction of the piezoelectric layers 41, 42 from being weakened by the electric fields generated in (applied to) the piezoelectric layers 41, 42.

Further, in this embodiment, the piezoelectric actuator 32 is driven by switching the potential of the individual electrode 52 between the ground potential and the predetermined positive potential while keeping the lower electrode 51 at the ground potential and keeping the upper electrodes 54 at the predetermined positive potential. However, while the lower electrode 51 is kept at a predetermined potential (first potential) different from the ground potential and the upper electrodes 54 are kept at a predetermined potential (second potential) different from the ground potential and the first potential, the potential of the individual electrode 52 may be switched between the aforesaid first potential and second potential.

Further, in the foregoing explanation, the state in which there is no potential difference between two electrodes is referred to as the same potential, but the same effects as those of the embodiment and the modified examples can be obtained, provided that a potential difference, if any between two electrodes, is minute.

Further, in this embodiment, the lower electrode 51 is formed as one electrode disposed over the pressure chambers 10, and the upper electrodes 54 are mutually connected by the wiring part 56. However, the following structure can also be adopted. That is, instead of the lower electrode 51, a plurality of lower electrodes (first electrodes) facing the pressure chambers 10 respectively and connected individually to the driver IC 70 are provided on the lower surface of the piezoelectric layer 41, the upper electrodes 54 are individually connected to the driver IC 70 without the wiring part 56 being provided on the upper surface of the piezoelectric layer 42. By separately controlling the potentials of the lower electrodes, the individual electrodes 52, and the upper electrodes 54 corresponding to the respective pressure chambers 10, the state may be switched between the state in which the electric field in the thickness direction is generated in the portion, of the piezoelectric layer 41, facing the pressure chamber 10 and no electric field in the thickness direction is generated in the piezoelectric layer 42 (first state) and the state in which the electric field in the thickness direction is generated in the portion, of the piezoelectric layer 42, facing the pressure chamber 10 and no electric field in the thickness direction is generated in the piezoelectric layer 41 (second state).

Further, in this embodiment and the modified examples except the modified example 4, it is possible to selectively take one of the states: that is, the state in which the first electrode and the third electrode have a potential difference and the second and the third electrode are at the same potential (first state); and the state in which the second electrode and the third electrode have a potential difference and the first electrode and the third electrode are at the same potential (second state). However, the following structure may also be adopted. That is, in addition to these first state and second state, it is possible to take a state in which the first electrode, the second electrode, and the third electrode are all at the same potential (for example, the ground potential), and by changing among these three states, the pressure is applied to the ink in the pressure chamber 10. Incidentally, in the state in which the first electrode, the second electrode, and the third electrode are all at the same potential, no electric field in the thickness direction is generated in the piezoelectric layers 41, 42, and thus the piezoelectric layers 41, 42 are not deformed.

In the above described explanation, the example is explained where the liquid transport apparatus, the liquid transport head, and the piezoelectric actuator according to the present invention are applied to the inkjet head of the printer jetting the ink from the nozzles 15 by changing the pressure of the ink in the pressure chambers, but the liquid transport apparatus, the liquid transport head, and the piezoelectric actuator according to the present invention are also applicable to a liquid transport apparatus transporting liquid other than ink. The piezoelectric actuator according to the present invention is also applicable to a piezoelectric actuator driving a driven object by the deformation of piezoelectric layers.

What is claimed is:

1. A liquid transport apparatus which transports a liquid, comprising:

a channel unit which has a liquid transport channel through which the liquid is transported and a pressure chamber formed in the liquid transport channel;

a piezoelectric actuator which applies a pressure to the liquid in the pressure chamber and which has a first piezoelectric layer, a second piezoelectric layer, a first electrode, a second electrode, and a third electrode, the first piezoelectric layer covering the pressure chamber and polarized in a thickness direction of the first piezoelectric layer, the second piezoelectric layer being joined to a surface, of the first piezoelectric layer, on a side not facing the pressure chamber and polarized in a thickness direction of the second piezoelectric layer, the first electrode being formed on a surface of the first piezoelectric layer, on a side facing the pressure chamber, at a portion facing the pressure chamber, the second electrode being formed on a surface of the second piezoelectric layer, on a side not facing the first piezoelectric layer, at a portion facing the pressure chamber, the third electrode being formed between the first piezoelectric layer and the second piezoelectric layer at a position at which the third electrode faces the pressure chamber;

a driving mechanism which drives the piezoelectric actuator and which has a potential applying mechanism applying potentials to the first electrode, the second electrode, and the third electrode respectively, and a controller controlling the potential applying mechanism;

wherein the controller controls the potential applying mechanism to switch between a first state and a second state, the first state being a state in which the first electrode and the third electrode have a potential difference and the second electrode and the third electrode are at a same potential, and the second state being a state in which the second electrode and the third electrode have a potential difference and the first electrode and the third electrode are at a same potential.

2. The liquid transport apparatus according to claim 1;

wherein the controller controls the potential applying mechanism to selectively apply one of a predetermined first potential and a predetermined second potential different from the first potential to the third electrode in a state that the first electrode is kept at the first potential and the second electrode is kept at the second potential.

3. The liquid transport apparatus according to claim 2;

wherein the second potential is a potential higher than the first potential, the first piezoelectric layer is polarized in a direction from the third electrode toward the first electrode, and the second piezoelectric layer is polarized in a direction from the second electrode toward the third electrode.

4. The liquid transport apparatus according to claim 3, further comprising:

a cover member which is disposed on the surface, of the first piezoelectric layer, on the side facing the pressure chamber and which covers the first electrode.

5. The liquid transport apparatus according to claim 2;

wherein the first potential is a potential higher than the second potential, the first piezoelectric layer is polarized in a direction from the first electrode toward the third electrode, and the second piezoelectric layer is polarized in a direction from the third electrode toward the second electrode.

6. The liquid transport apparatus according to claim 5, further comprising:

a cover member which is disposed on the surface, of the first piezoelectric layer, on the side facing the pressure chamber and which covers the first electrode.

7. The liquid transport apparatus according to claim 1;

wherein the controller controls the potential applying mechanism to produce the first state, while keeping the second electrode and the third electrode at a predetermined first potential, by applying a second potential different from the first potential to the first electrode, and to produce the second state by applying the second potential to the second electrode, while keeping the first electrode and the third electrode at the first potential.

8. The liquid transport apparatus according to claim 7;

wherein the first piezoelectric layer is polarized in a direction from the first electrode toward the third electrode, and the second piezoelectric layer is polarized in a direction from the second electrode toward the third electrode.

9. A liquid transport head which transports a liquid, comprising:

a channel unit which has a liquid transport channel through which the liquid is transported and a pressure chamber formed in the liquid transport channel; and a piezoelectric actuator which applies a pressure to the liquid in the pressure chamber and which has a first piezoelectric layer, a second piezoelectric layer, a first electrode, a second electrode, and a third electrode, the first piezoelectric layer covering the pressure chamber and polarized in a thickness direction of the first piezoelectric layer, the second piezoelectric layer being joined to a surface, of the first piezoelectric layer, on a side not facing the pressure chamber and polarized in a thickness direction of the second piezoelectric layer, the first electrode being formed on a surface of the first piezoelectric layer, on a side facing the pressure chamber, at a portion facing the pressure chamber, the second electrode being formed on a surface of the second piezoelectric layer, on a side not facing the first piezoelectric layer, at a portion facing the pressure chamber, and the third electrode being formed between the first piezoelectric layer and the second piezoelectric layer at a position at which the third electrode faces the pressure chamber;

wherein potentials are applied to the first electrode, the second electrode, and the third electrode respectively; and wherein one of a predetermined first potential and a predetermined second potential different from the first potential is selectively applied to the third electrode in a state that the first electrode is kept at the first potential and the second electrode is kept at the second potential.

10. A piezoelectric actuator comprising:

a first piezoelectric layer which is polarized in a thickness direction of the first piezoelectric layer;

a second piezoelectric layer which is joined to one surface of the first piezoelectric layer and which is polarized in a thickness direction of the second piezoelectric layer;

a first electrode formed on the other surface, of the first piezoelectric layer, on a side not facing the second piezoelectric layer;

a second electrode formed on a surface of the second piezoelectric layer, on a side not facing the first piezoelectric layer, at a portion facing the first electrode; and a third electrode formed between the first piezoelectric layer and the second piezoelectric layer at a position at which the third electrode faces the first electrode and the second electrode;

wherein potentials are applied individually to the first electrode, the second electrode, and the third electrode respectively; and wherein one of a predetermined first potential and a predetermined second potential different from the first potential is selectively applied to the third electrode in a state that the first electrode is kept at the first potential and the second electrode is kept at the second potential.

* * * * *